US009476329B2

(12) United States Patent
Fischer et al.

(10) Patent No.: US 9,476,329 B2
(45) Date of Patent: Oct. 25, 2016

(54) CAMSHAFT PHASER WITH A ROTARY VALVE SPOOL POSITIONED HYDRAULICALLY

(71) Applicant: DELPHI TECHNOLOGY INC., Troy, MI (US)

(72) Inventors: Thomas H. Fischer, Rochester, NY (US); Karl J. Haltiner, Jr., Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 143 days.

(21) Appl. No.: 14/570,189

(22) Filed: Dec. 15, 2014

(65) Prior Publication Data

US 2016/0169060 A1 Jun. 16, 2016

(51) Int. Cl.

| | |
|---|---|
| ***F01L 1/34*** | (2006.01) |
| ***F01L 1/344*** | (2006.01) |
| ***F01L 1/047*** | (2006.01) |
| ***F04C 2/344*** | (2006.01) |

(52) U.S. Cl.

CPC ..... *F01L 1/3442* (2013.01); *F01L 1/047* (2013.01); *F04C 2/344* (2013.01); *F01L 2001/34426* (2013.01)

(58) Field of Classification Search

CPC ..... F01L 2001/34493; F01L 2001/34426; F01L 2001/34433; F01L 2001/34486; F01L 2001/34489; F01L 2001/34496; F01L 1/3442

See application file for complete search history.

(56) References Cited

U.S. PATENT DOCUMENTS

| | | | | |
|---|---|---|---|---|
| 5,507,254 | A | 4/1996 | Melchior et al. | |
| 5,645,017 | A | 7/1997 | Melchior et al. | |
| 5,649,506 | A | 7/1997 | Melchior et al. | |
| 7,523,728 | B2 | 4/2009 | Berndorfer | |
| 8,534,246 | B2 | 9/2013 | Lichti et al. | |
| 9,366,162 | B1 * | 6/2016 | Haltiner, Jr. | F01L 1/3442 |
| 2007/0039581 | A1 | 2/2007 | Berndorfer | |
| 2013/0284134 | A1 * | 10/2013 | Methley | F01L 1/344 123/90.17 |
| 2014/0116365 | A1 * | 5/2014 | Scheidig | F01L 1/34409 123/90.17 |

FOREIGN PATENT DOCUMENTS

| | | | | |
|---|---|---|---|---|
| DE | WO 2012171670 | A1 * | 12/2012 | F01L 1/34409 |
| EP | 2075421 | A1 | 7/2009 | |
| GB | 2487227 | A1 | 7/2012 | |

OTHER PUBLICATIONS

U.S. Appl. No. 14/554,385 Haltiner et al.
U.S. Appl. No. 14/554,400 Haltiner et al.

* cited by examiner

*Primary Examiner* — Thomas Denion
*Assistant Examiner* — Daniel Bernstein
(74) *Attorney, Agent, or Firm* — Joshua M. Haines

(57) ABSTRACT

A camshaft phaser includes an input member; an output member defining a phasing advance chamber and a phasing retard chamber with the input member; and a rotary valve spool coaxially disposed within the output member such that the rotary valve spool is rotatable relative to the output member and the input member, the valve spool defining a rotary valve spool advance chamber and a rotary valve spool retard chamber. Oil supplied to the rotary valve spool advance chamber causes the rotary valve spool to rotate relative to the output member and relative to the input member in a retard direction and oil supplied to the rotary valve spool retard chamber causes the rotary valve spool to rotate relative to the output member and relative to the input member in an advance direction.

27 Claims, 17 Drawing Sheets

CAMSHAFT PHASER WITH A ROTARY VALVE SPOOL POSITIONED HYDRAULICALLY

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which includes a rotary valve spool in which the position of the rotary valve spool determines the phase relationship between the crankshaft and the camshaft; and still even more particularly to such a camshaft phaser which uses hydraulics to position the rotary valve spool, and still yet even more particularly to such a camshaft phaser which includes a linear valve spool to control oil flow for positioning the rotary valve spool.

BACKGROUND OF INVENTION

Camshaft phasers are known for changing the phase relationship between a crankshaft and a camshaft in an internal combustion engine in order to achieve desired engine performance. U.S. Pat. No. 5,507,254 to Melchior, hereinafter referred to as Melchior, teaches a camshaft phaser comprising a rotor with an outward extending vane and a stator with an inward extending lobe such that the rotor is located within the stator and the vane and lobe together define and advance chamber and a retard chamber. Oil is selectively supplied to either the advance chamber or the retard chamber and vacated from the other of the advance chamber and retard chamber as directed by a phasing oil control valve in order to rotate the rotor within the stator and thereby change the phase relationship between the camshaft and the crankshaft. It is also known in the camshaft phaser art to provide the rotor with a plurality of vanes and to provide the stator with a plurality of lobes, thereby defining a plurality of alternating advance chambers and retard chambers. Melchior also teaches that the phasing oil control valve that may be rotated in order to supply and vacate oil from the advance chamber and the retard chamber. The phasing oil control valve is directly and mechanically rotated by an arm that is sensitive to engine speed such that the rotational position of the phasing oil control valve determines the rotational position of the rotor relative to the stator. The valve spool defines a first recess and a second recess separated by a rib such that one of the recesses acts to supply oil to the advance chamber when a retard in timing of the camshaft is desired while the other recess acts to supply oil to the retard chamber when an advance in the timing of the camshaft is desired. The recess that does not act to supply oil when a change in phase is desired does not act as a flow path. Rotating the phasing oil control valve directly and mechanically by an arm that is sensitive to engine speed may not be adequate for operation because modern internal combustion engines rely on many parameters, typically provided by various sensors which monitor various aspects of engine performance, processed by an electronic processor, for example an engine control module, to determine a desired camshaft phase. Consequently, it is desirable to rotationally position the phasing oil control valve taking into account any number of engine performance indicators.

What is needed is a camshaft phaser which minimizes or eliminates one or more of the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine where the camshaft phaser includes an input member which is connectable to the crankshaft of the internal combustion engine to provide a fixed ratio of rotation between the input member and the crankshaft; an output member which is connectable to the camshaft of the internal combustion engine and defining a phasing advance chamber and a phasing retard chamber with the input member; and a rotary valve spool coaxially disposed within the output member such that the rotary valve spool is rotatable relative to the output member and the input member, the valve spool defining a rotary valve spool advance chamber and a rotary valve spool retard chamber. Oil supplied to the rotary valve spool advance chamber causes the rotary valve spool to rotate relative to the output member and relative to the input member in a retard direction; oil supplied to the rotary valve spool retard chamber causes the rotary valve spool to rotate relative to the output member and relative to the input member in an advance direction; rotation of the rotary valve spool in the advance direction allows oil to be supplied to the retard chamber, thereby causing the output member to rotate relative to the input member in the advance direction; and rotation of the rotary valve spool in the retard direction allows oil to be supplied to the advance chamber, thereby causing the output member to rotate relative to the input member in the retard direction.

A camshaft phaser is also provided for use with an internal combustion engine for controllably varying the phase relationship between a crankshaft and a camshaft in the internal combustion engine where the camshaft phaser includes an input member connectable to the crankshaft of the internal combustion engine to provide a fixed ratio of rotation between the input member and the crankshaft; an output member connectable to the camshaft of the internal combustion engine and defining a phasing advance chamber and a phasing retard chamber with the input member; a rotary valve spool coaxially disposed within the output member such that the rotary valve spool is rotatable relative to the output member and the input member; and a biasing arrangement which applies torque to the rotary valve spool toward a predetermined rotary valve spool position relative to the input member. Rotation of the rotary valve spool in the advance direction allows oil to be supplied to the retard chamber, thereby causing the output member to rotate relative to the input member in the advance direction; and rotation of the rotary valve spool in the retard direction allows oil to be supplied to the advance chamber, thereby causing the output member to rotate relative to the input member in the retard direction.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
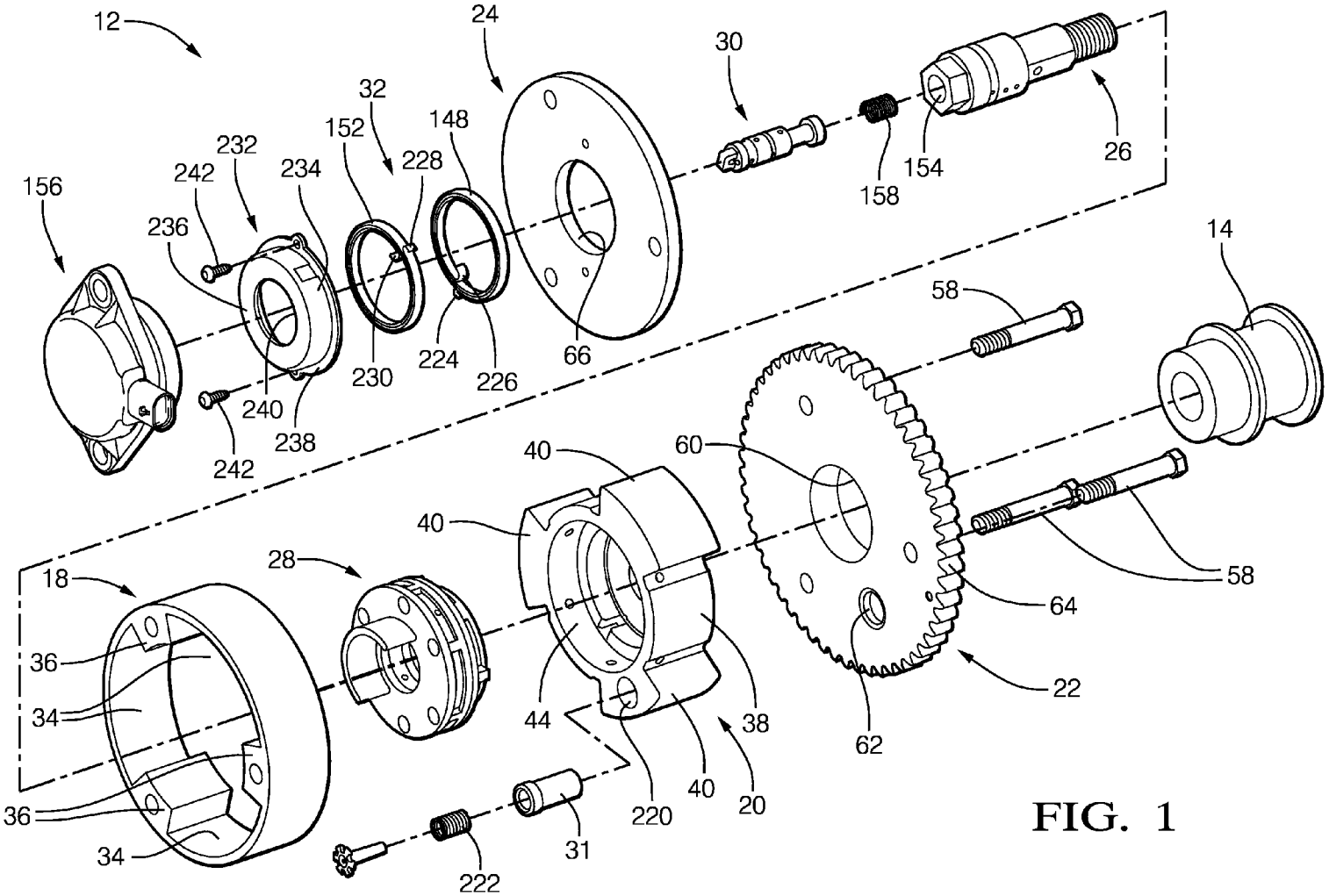
FIG. 1 is an exploded isometric view of a camshaft phaser in accordance with the present invention.
Figure 2:
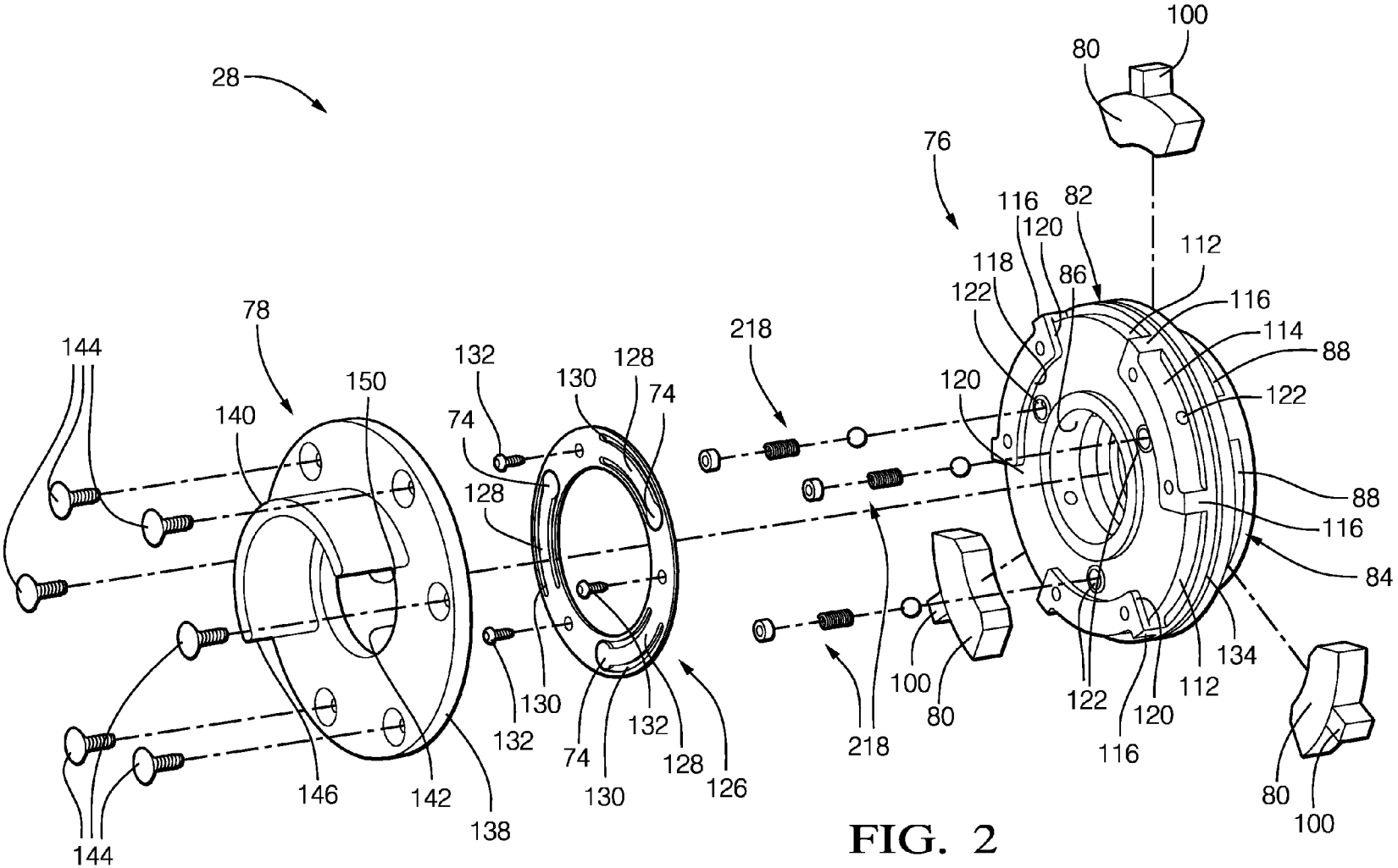
FIG. 2 is an exploded isometric view of a rotary valve spool of the camshaft phaser in accordance with the present invention.

In accordance with a preferred embodiment of this invention and referring to FIGS. 1-5, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing or phase between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one axial end of stator 18, a front cover 24 closing off the other axial end of stator 18, a camshaft phaser attachment bolt 26 for attaching camshaft phaser 12 to camshaft 14, a rotary valve spool 28 used to direct oil for rotating rotor 20 relative to stator 18, a linear valve spool 30 used to supply oil to rotary valve spool 28 for rotationally positioning rotary valve spool 28 relative to stator 18, a lock pin 31 for selectively preventing relative rotation between rotor 20 and stator 18, and a biasing arrangement 32 for biasing rotary valve spool 28 to a predetermined rotary valve spool position of rotary valve spool 28 relative to stator 18. The rotational position of rotary valve spool 28 relative to stator 18 determines the rotational position of rotor 20 relative to stator 18, unlike typical valve spools which move axially to determine only the direction the rotor will rotate relative to the stator. The various elements of camshaft phaser 12 will be described in greater detail in the paragraphs that follow.

Stator 18 is generally cylindrical and includes a plurality of radial chambers 34 defined by a plurality of lobes 36 extending radially inward. In the embodiment shown, there are three lobes 36 defining three radial chambers 34, however, it is to be understood that a different number of lobes 36 may be provided to define radial chambers 34 equal in quantity to the number of lobes 36.

Rotor 20 includes a rotor central hub 38 with a plurality of vanes 40 extending radially outward therefrom, a rotor central through bore 42 extending axially therethrough, and a stepped rotor valve spool recess 44 coaxial with rotor central through bore 42 and extending part way into rotor 20 from the axial end of rotor 20 that is distal from camshaft 14. The number of vanes 40 is equal to the number of radial chambers 34 provided in stator 18. Rotor 20 is coaxially disposed within stator 18 such that each vane 40 divides each radial chamber 34 into phasing advance chambers 46 and phasing retard chambers 48. The radial tips of lobes 36 are mateable with rotor central hub 38 in order to separate radial chambers 34 from each other. While not shown, each of the radial tips of vanes 40 may include a wiper seal to substantially seal adjacent phasing advance chambers 46 and phasing retard chambers 48 from each other as shown in United States Patent Application Publication No. US 2014/0123920 A1 to Lichti et al., the disclosure of which is incorporated herein by reference in its entirety. Similarly, each of the radial tips of lobes 36 may also include a wiper seal to substantially seal adjacent phasing advance chambers 46 and phasing retard chambers 48 from each other.

Rotor valve spool recess 44 is defined by an outer rotor valve spool recess bore 50 and an inner rotor valve spool recess bore 52 axially adjacent to outer rotor valve spool recess bore 50 such that outer rotor valve spool recess bore 50 is larger in diameter than inner rotor valve spool recess bore 52 and such that inner rotor valve spool recess bore 52 is axially between outer rotor valve spool recess bore 50 and rotor central through bore 42. An outer valve spool recess shoulder 54 is defined by the surface of rotor valve spool recess 44 which connects inner rotor valve spool recess bore 52 to outer rotor valve spool recess bore 50 such that outer valve spool recess shoulder 54 is annular in shape and substantially perpendicular to camshaft axis 16. Inner rotor valve spool recess bore 52 is larger in diameter than rotor central through bore 42, and consequently, an inner valve spool recess shoulder 56 is defined by the surface of rotor valve spool recess bore 44 which connects rotor central through bore 42 to inner rotor valve spool recess bore 52 such that inner valve spool recess shoulder 56 is annular in shape and substantially perpendicular to camshaft axis 16.

Back cover 22 is sealingly secured, using cover bolts 58, to the axial end of stator 18 that is proximal to camshaft 14. Tightening of cover bolts 58 prevents relative rotation between back cover 22 and stator 18. Back cover 22 includes a back cover central bore 60 extending coaxially therethrough. The end of camshaft 14 is received coaxially within back cover central bore 60 such that camshaft 14 is allowed to rotate relative to back cover 22. Back cover 22 may also include a lock pin seat 62 which selectively receives lock pin 31 as will be described in greater detail later. Back cover 22 may also include a sprocket 64 formed integrally therewith or otherwise fixed thereto. Sprocket 64 is configured to be driven by a chain that is driven by the crankshaft of internal combustion engine 10. Alternatively, sprocket 64 may be a pulley driven by a belt or any other known drive member for driving camshaft phaser 12 by the crankshaft. In an alternative arrangement, sprocket 64 may be integrally formed or otherwise attached to stator 18 rather than back cover 22.

Similarly, front cover 24 is sealingly secured, using cover bolts 58, to the axial end of stator 18 that is opposite back cover 22. Cover bolts 58 pass through back cover 22 and stator 18 and threadably engage front cover 24; thereby clamping stator 18 between back cover 22 and front cover 24 to prevent relative rotation between stator 18, back cover 22, and front cover 24. In this way, phasing advance chambers 46 and phasing retard chambers 48 are defined axially between back cover 22 and front cover 24. Front cover 24 includes a front cover central bore 66 extending coaxially therethrough.

Camshaft phaser 12 is attached to camshaft 14 with camshaft phaser attachment bolt 26 which extends coaxially through rotor central through bore 42 of rotor 20 and threadably engages camshaft 14, thereby by clamping rotor 20 securely to camshaft 14. More specifically, camshaft phaser attachment bolt 26 includes a camshaft phaser attachment bolt shoulder 68 which is substantially perpendicular to camshaft axis 16 and which mates with inner valve spool recess shoulder 56 of rotor 20. Consequently, rotor 20 is clamped between camshaft phaser attachment bolt shoulder 68 and camshaft 14. In this way, relative rotation between stator 18 and rotor 20 results in a change in phase or timing between the crankshaft of internal combustion engine 10 and camshaft 14.

Oil is selectively transferred to phasing advance chambers 46 from phasing retard chambers 48, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to phasing retard chambers 48 from phasing advance chambers 46, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 70 may be provided in rotor 20 for supplying and venting oil to and from phasing advance chambers 46 while rotor retard passages 72 may be provided in rotor 20 for supplying and venting oil to and from phasing retard chambers 48. Rotor advance passages 70 extend radially outward through rotor central hub 38 from outer rotor valve spool recess bore 50 to phasing advance chambers 46 while rotor retard passages 72 extend radially outward through rotor central hub 38 from outer rotor valve spool recess bore 50 to phasing retard chambers 48. Transferring oil to phasing advance chambers 46 from phasing retard chambers 48 and transferring oil to phasing retard chambers 48 from phasing advance chambers 46 is controlled by rotary valve spool 28, recirculation check valves 74, and linear valve spool 30 as will be described in detail later, such that rotary valve spool 28 is disposed coaxially and rotatably within stepped rotor valve spool recess 44.

Rotor 20 and rotary valve spool 28, which act together to function as a valve to rotate rotor 20 relative to stator 18, will now be described in greater detail with continued reference to FIGS. 1-5. Rotary valve spool 28 includes a rotary valve body 76, a rotary valve spool biasing body 78, and rotary valve spool vanes 80.

Rotary valve body 76 is defined by a rotary valve body outer portion 82 located within outer rotor valve spool recess bore 50 and a rotary valve body inner portion 84 located within inner rotor valve spool recess bore 52 such that a rotary valve body through bore 86 is centered about camshaft axis 16 and extends coaxially through rotary valve body outer portion 82 and rotary valve body inner portion 84. Camshaft phaser attachment bolt 26 extends coaxially through rotary valve body through bore 86 in a close sliding interface such that rotary valve body 76 is able to rotate freely relative to camshaft phaser attachment bolt 26 while substantially preventing oil from passing between the interface of camshaft phaser attachment bolt 26 and rotary valve body through bore 86. Rotary valve body inner portion 84 is coaxially located within inner rotor valve spool recess bore 52 and is sized to mate radially with inner rotor valve spool recess bore 52 in a close sliding interface such that rotary valve body inner portion 84 is able to freely rotate within inner rotor valve spool recess bore 52 while substantially preventing oil from passing between the interface of rotary valve body inner portion 84 and inner rotor valve spool recess bore 52. A plurality of rotary valve body phasing chambers 88 extend radially into rotary valve body inner portion 84 from the outer circumference thereof such that rotary valve body phasing chambers 88 are arranged in a polar array where adjacent rotary valve body phasing chambers 88 are sealingly separated from each other by one of a plurality of rotary valve body phasing chamber walls 90 and such that rotary valve body phasing chambers 88 are formed in the shape of a segment of an annulus. In the embodiment shown, there are three rotary valve body phasing chambers 88, however, any number of rotary valve body phasing chambers 88 may be provided. Rotary valve body phasing chambers 88 are delimited axially at one end by a rotary valve body inner portion end wall 92 which defines an axial end of rotary valve body inner portion 84 that is proximal to inner valve spool recess shoulder 56 and rotary valve body phasing chambers 88 are delimited axially at the other end by rotary valve body outer portion 82. Rotary valve body phasing chambers 88 are delimited radially inward by a rotary valve body inner portion inner wall 94 and are delimited radially outward by inner rotor valve spool recess bore 52.

Each rotary valve spool vane 80 is received within a respective rotary valve body phasing chamber 88, thereby dividing each rotary valve body phasing chamber 88 into a rotary valve spool advance chamber 96 and a rotary valve spool retard chamber 98. Each rotary valve spool vane 80 is formed in the shape of a segment of an annulus which mates radially inward with rotary valve body inner portion inner wall 94 and radially outward with inner rotor valve spool recess bore 52 in close sliding interfaces such that rotary valve body 76 is able to rotate relative to rotary valve spool vanes 80 while substantially preventing oil from passing between the interface formed between rotary valve spool vanes 80 and rotary valve body inner portion inner wall 94 and the interfaces formed between rotary valve spool vanes 80 and inner rotor valve spool recess bore 52. Rotary valve spool vanes 80 are sized to mate axially with rotary valve body inner portion end wall 92 and axially with rotary valve body outer portion 82 in close sliding interfaces such that, that rotary valve body 76 is able to rotate relative to rotary valve spool vanes 80 while substantially preventing oil from passing between the interface formed between rotary valve spool vanes 80 and rotary valve body inner portion end wall 92 and the interfaces formed between rotary valve spool vanes 80 and rotary valve body outer portion 82. In this way, rotary valve spool advance chambers 96 and rotary valve spool retard chambers 98 are fluidly isolated from each other. It should be noted that each rotary valve spool vane 80 has an angular length that is less than the angular length of each rotary valve body phasing chamber 88, thereby allowing rotary valve body 76 to rotate relative to rotor 20. Each rotary valve spool vane 80 is fixed to rotor 20 in order to prevent relative movement between rotary valve spool vanes 80 and rotor 20. As shown, each rotary valve spool vane 80 may be fixed to rotor 20 by a rotary valve spool vane rib 100 which extends radially outward therefrom and engages a complementary rotor notch 102 which extends radially outward from inner rotor valve spool recess bore 52. During assembly of camshaft phaser 12, rotary valve spool vanes 80 are first assembled into respective rotary valve body phasing chambers 88, then rotary valve spool 28 is inserted into rotor valve spool recess 44, thereby engaging rotary valve spool vane ribs 100 with rotor notches 102.

Oil is selectively supplied to rotary valve spool retard chambers 98 and vented from rotary valve spool advance chambers 96 in order to rotate rotary valve spool 28 in the advance direction of rotation. Conversely, oil is selectively supplied to rotary valve spool advance chambers 96 and vented from rotary valve spool retard chambers 98 in order to rotate rotary valve spool 28 in the retard direction of rotation. For clarity, FIGS. 4, 5, 7B-7E, and 9B-9E include arrows indicating the directions of advance and retard because in FIGS. 4, 7C-7E and 9C-9E advance is clockwise and retard is counterclockwise due to the direction of viewing camshaft phaser 12 while in FIGS. 5, 7B, and 9B advance is counterclockwise and retard is clockwise due to the direction of viewing camshaft phaser 12. Rotary valve spool advance passages 104 may be provided in rotary valve body 76 for supplying and venting oil to and from rotary valve spool advance chambers 96 while rotary valve spool retard passages 106 may be provided in rotary valve body 76 for supplying and venting oil to and from rotary valve spool retard chambers 98. Rotary valve spool advance passages 104 extend from respective rotary valve spool advance chambers 96 through rotary valve body 76 to a rotary valve body annular advance groove 108 which is formed in rotary valve body 76 such that rotary valve body annular advance groove 108 extends radially outward from rotary valve body through bore 86. Similarly, rotary valve spool retard passages 106 extend from respective rotary valve spool retard chambers 98 through rotary valve body 76 to a rotary valve body annular retard groove 110 which is formed in rotary valve body 76 such that rotary valve body annular retard groove 110 extends radially outward from rotary valve body through bore 86. Rotary valve body annular retard groove 110 is axially spaced from rotary valve body annular advance groove 108 such that rotary valve body annular retard groove 110 is proximal to camshaft 14 and rotary valve body annular advance groove 108 is distal from camshaft 14.

Rotary valve body outer portion 82 is coaxially located within outer rotor valve spool recess bore 50 and is sized to mate radially with outer rotor valve spool recess bore 50 in a close sliding interface such that rotary valve body outer portion 82 is able to freely rotate within outer rotor valve spool recess bore 50 while substantially preventing oil from passing between the interface of rotary valve body outer portion 82 and outer rotor valve spool recess bore 50. A plurality of supply chambers 112 and a plurality of vent chambers 114 are formed in the outer circumference of rotary valve body outer portion 82 such that adjacent supply chambers 112 and vent chambers 114 are separated by respective rotary valve spool lands 116 which are sized to be about the same width as rotor advance passages 70 and rotor retard passages 72. Each supply chamber 112 and each vent chamber 114 extends axially part way along the length of rotary valve spool biasing body 78 from the axial end of rotary valve body outer portion 82 that mates with rotary valve spool biasing body 78. An annular rotary valve spool recirculation groove 118 is formed in the axial end rotary valve body outer portion 82 that mates with rotary valve spool biasing body 78. Fluid communication between annular rotary valve spool recirculation groove 118 and supply chambers 112 is provided by a plurality of recirculation recesses 120 formed in the axial face of rotary valve body outer portion 82 that mates with rotary valve spool biasing body 78. Fluid communication between annular rotary valve spool recirculation groove 118 and vent chambers 114 is provided by a plurality of rotary valve spool recirculation passages 122 formed in rotary valve body outer portion 82 such that each rotary valve spool recirculation passage 122 extends radially inward from a respective vent chambers 114, then axially to annular rotary valve spool recirculation groove 118. Recirculation check valves 74 allow oil to flow from vent chambers 114 to supply chambers 112 while preventing oil from flowing from supply chambers 112 to vent chambers 114 as will be described in greater detail later. Each recirculation check valve 74 may be integrally formed as part of a recirculation check valve plate 126 which is annular in shape and sized to fit within annular rotary valve spool recirculation groove 118 such that the thickness of recirculation check valve plate 126 is less than the depth of annular rotary valve spool recirculation groove 118. Each recirculation check valve 74 may be located at the end of a recirculation check valve arm 128 which is defined by a recirculation check valve slot 130 formed through recirculation check valve plate 126. In this way, each recirculation check valve 74 acts as a reed valve and can be easily and economically formed, by way of non-limiting example only, by stamping sheet metal stock. Recirculation check valve plate 126 may be radially indexed and retained within annular rotary valve spool recirculation groove 118 by recirculation check valve plate screws 132 which extend through recirculation check valve plate 126 and threadably engage rotary valve body outer portion 82. An annular rotary valve body lock pin groove 134 is formed on the outer circumference of rotary valve body outer portion 82 such that annular rotary valve body lock pin groove 134 is axially between supply chambers 112 and rotary valve body inner portion 84 and such that annular rotary valve body lock pin groove 134 is aligned with a rotor lock pin passage 136 in rotor 20 which is used to supply and vent oil to and from lock pin 31 as will be described in greater detail later. A rotary valve spool lock pin passage 137 extends from annular rotary valve body lock pin groove 134 to the inner circumference of rotary valve body through bore 86 for supplying and venting oil to and from annular rotary valve body lock pin groove 134 as will also be described in greater detail later.

Rotary valve spool biasing body 78 includes a rotary valve spool biasing body base 138 located axially between rotary valve body outer portion 82 and front cover 24 and also includes a bias spring extension 140 which extends axially away from rotary valve spool biasing body base 138 and through front cover central bore 66. Rotary valve spool biasing body base 138 is annular in shape and sized to mate radially with outer rotor valve spool recess bore 50 in a close sliding interface such that rotary valve spool biasing body base 138 is able to freely rotate within outer rotor valve spool recess bore 50 while substantially preventing oil from passing between the interface of rotary valve spool biasing body base 138 and outer rotor valve spool recess bore 50. Rotary valve spool biasing body base 138 includes a rotary valve spool biasing body central through bore 142 which extends axially therethrough such that rotary valve spool biasing body base 138 is centered about camshaft axis 16. Rotary valve spool biasing body central through bore 142 is sized to mate radially with camshaft phaser attachment bolt 26 in a close sliding interface such that rotary valve spool biasing body base 138 is able to freely rotate relative to camshaft phaser attachment bolt 26 while substantially preventing oil from passing between the interface of rotary valve spool biasing body central through bore 142 and camshaft phaser attachment bolt 26. Rotary valve spool biasing body base 138 is sealingly secured to rotary valve body outer portion 82 with rotary valve spool biasing body screws 144 which extend through rotary valve spool biasing body base 138 and threadably engage rotary valve body outer portion 82, thereby substantially preventing oil from passing between the interface of rotary valve spool biasing body base 138 and rotary valve body outer portion 82. Bias spring extension 140 is arc shaped, thereby defining a first bias spring extension end 146 for engaging one end of an advance bias spring 148 as will be discussed in greater detail later and also defining a second bias spring extension end 150 for engaging one end of a retard bias spring 152 as will also be discussed in greater detail later.

Figure 6:
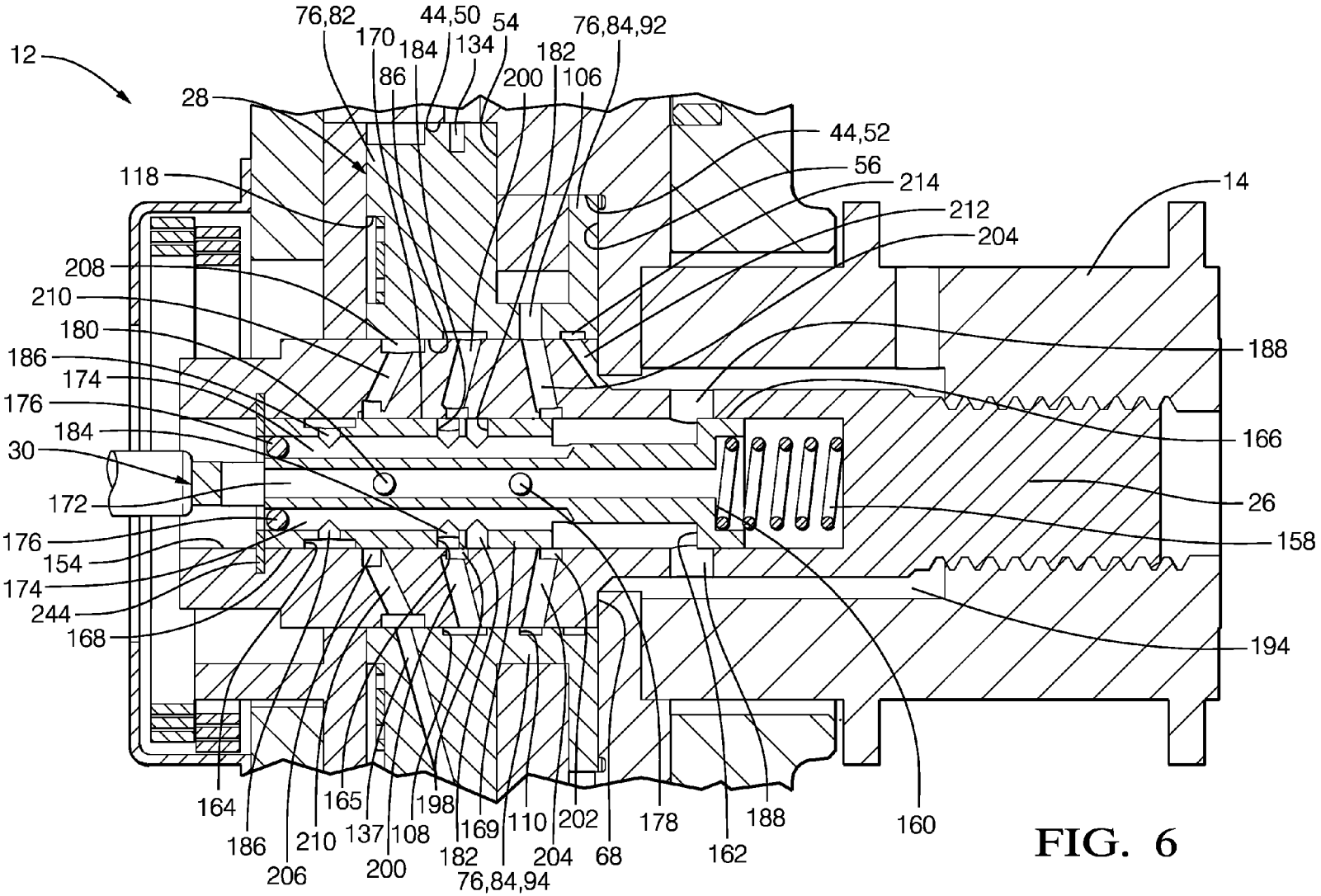
FIG. 6 is an axial cross-sectional view of a portion of the camshaft phaser of FIG. 1 with a linear valve spool of the camshaft phaser in a default position.

Linear valve spool 30 and camshaft phaser attachment bolt 26, which act together to function as a valve to rotate rotary valve spool 28 relative to stator 18 and rotor 20, will now be described in greater detail with continued reference to FIGS. 1-5 and now with additional reference to FIG. 6. Linear valve spool 30 is located within a valve bore 154 of camshaft phaser attachment bolt 26 such that valve bore 154 is centered about camshaft axis 16 and such that linear valve spool 30 is moved axially within valve bore 154 by an actuator 156 and a valve spring 158.

Linear valve spool 30 is sized to mate radially with valve bore 154 in a close sliding interface such that linear valve spool 30 is able to freely slide axially within valve bore 154 while substantially preventing oil from passing between the interface of linear valve spool 30 and valve bore 154. A linear valve spool spring seat 160 is formed at one axial end of linear valve spool 30 for receiving one end of valve spring 158, thereby capturing valve spring 158 axially between linear valve spool 30 and the bottom of valve bore 154. Three grooves extend radially into linear valve spool 30 where a linear valve spool supply groove 162 extends radially into linear valve spool 30 near the end of linear valve spool 30 which defines linear valve spool spring seat 160, a linear valve spool lock pin supply groove 164 extends radially into linear valve spool 30 near the end of linear valve spool 30 that is distal from linear valve spool spring seat 160, and a linear valve spool advance supply groove 165 extends radially into linear valve spool 30 at a location axially between linear valve spool supply groove 162 and linear valve spool lock pin supply groove 164. Consequently, linear valve spool supply groove 162, linear valve spool lock pin supply groove 164, and linear valve spool advance supply groove 165 define four lands on linear valve spool 30 where a linear valve spool supply land 166 is located at the end of linear valve spool 30 that is proximal to the bottom of valve bore 154, a linear valve spool vent land 168 is located at the end of linear valve spool 30 that is opposite linear valve spool supply land 166, a linear valve spool retard land 169 is located between linear valve spool supply land 166 and linear valve spool vent land 168 such that linear valve spool retard land 169 is proximal to linear valve spool supply land 166, and a linear valve spool advance land 170 is located between linear valve spool supply land 166 and linear valve spool retard land 169. A linear valve spool axial vent passage 172 extends axially into linear valve spool 30 from linear valve spool spring seat 160 such that linear valve spool axial vent passage 172 is centered about camshaft axis 16. A pair of linear valve spool axial supply passages 174 extend axially within linear valve spool 30 from linear valve spool supply groove 162 such that each linear valve spool axial supply passage 174 is radially offset from linear valve spool axial vent passage 172 and substantially parallel to linear valve spool axial vent passage 172. In order to facilitate formation of linear valve spool axial vent passage 172, each linear valve spool axial vent passage 172 may begin at linear valve spool vent land 168 and a plug 176 is placed in the end of each linear valve spool axial supply passage 174 that is proximal to linear valve spool vent land 168 in order to terminate each linear valve spool axial supply passages 174. Linear valve spool axial vent passage 172 includes a first linear valve spool radial vent passage 178 extending radially outward therefrom and through linear valve spool retard land 169 to the outer circumference of linear valve spool retard land 169 and a second linear valve spool radial vent passage 180 extending radially outward therefrom and through linear valve spool advance land 170 to the outer circumference of linear valve spool advance land 170. Each linear valve spool axial supply passages 174 includes a linear valve spool retard supply passage 182 extending radially outward therefrom and through linear valve spool retard land 169 to the outer circumference of linear valve spool retard land 169, a linear valve spool advance supply passage 184 extending radially outward therefrom to linear valve spool advance supply groove 165, and a linear valve spool lock pin supply passage 186 extending radially outward therefrom to linear valve spool lock pin supply groove 164.

Camshaft phaser attachment bolt 26 includes bolt supply passages 188 extending radially outward from valve bore 154 to the outer circumference of camshaft phaser attachment bolt 26 in order to supply oil to linear valve spool lock pin supply groove 164 from an oil source 190, which may be, by way of non-limiting example only, an oil pump of internal combustion engine 10 which may also provide lubrication to various elements of internal combustion engine 10. The oil from oil source 190 is supplied to bolt supply passages 188 through a camshaft supply passage 192 of camshaft 14 and an annular supply passage 194 formed radially between camshaft phaser attachment bolt 26 and a camshaft counter bore 196 of camshaft 14. Camshaft phaser attachment bolt 26 also includes a bolt annular advance groove 198 that extends radially outward from valve bore 154 such that bolt advance passages 200 extend from bolt annular advance groove 198 to the outer circumference of camshaft phaser attachment bolt 26 where bolt advance passages 200 provide fluid communication from bolt annular advance groove 198 to rotary valve body annular advance groove 108. Camshaft phaser attachment bolt 26 also includes a bolt annular retard groove 202 that extends radially outward from valve bore 154 such that bolt retard passages 204 extend from bolt annular retard groove 202 to the outer circumference of camshaft phaser attachment bolt 26 where bolt retard passages 204 provide fluid communication from bolt annular retard groove 202 to rotary valve body annular retard groove 110. Bolt annular advance groove 198 is spaced axially apart from bolt annular retard groove 202 such that bolt annular retard groove 202 is closer to the bottom of valve bore 154 than bolt annular advance groove 198. Camshaft phaser attachment bolt 26 also includes bolt inner annular lock pin groove 206 which extends radially outward form valve bore 154, a bolt outer annular lock pin groove 208 which extends radially inward from the outer circumference of camshaft phaser attachment bolt 26, and bolt lock pin passages 210 which extend from bolt inner annular lock pin groove 206 to bolt outer annular lock pin groove 208. Bolt inner annular lock pin groove 206 is spaced axially apart from bolt annular advance groove 198 such that bolt annular advance groove 198 is axially between bolt inner annular lock pin groove 206 and bolt annular retard groove 202. Bolt outer annular lock pin groove 208 is aligned with rotary valve spool lock pin passage 137 of rotary valve body 76. Camshaft phaser attachment bolt 26 also includes bolt make-up oil passages 212 (only one bolt make-up oil passage 212 is shown in the figures) therein which provide fluid communication from annular supply passage 194 to a rotary valve body make-up groove 214 which extends radially inward from rotary valve body through bore 86 of rotary valve body 76 where a plurality of rotary valve body make-up passages 216 provide fluid communication from rotary valve body make-up groove 214 to rotary valve spool recirculation passages 122. A make-up check valve 218 is provided in each rotary valve body make-up passage 216 in order to prevent oil from flowing from rotary valve spool recirculation passages 122 to rotary valve body make-up groove 214 while allowing oil to flow from rotary valve body make-up groove 214 to rotary valve spool recirculation passages 122.

Lock pin 31 selectively prevents relative rotation between stator 18 and rotor 20 at a predetermined rotor position of rotor 20 within stator 18, which as shown, may be between a full advance position, i.e. rotor 20 is rotated as far as possible within stator 18 in the advance direction of rotation, and a full retard position, i.e. rotor 20 is rotated as far as possible within stator 18 in the retard direction of rotation. Lock pin 31 is slidably disposed within a lock pin bore 220 formed in one vane 40 of rotor 20. Lock pin 31 and lock pin seat 62 are sized to substantially prevent rotation between stator 18 and rotor 20 when lock pin 31 is received within lock pin seat 62. When lock pin 31 is not desired to be seated within lock pin seat 62, pressurized oil is supplied to lock pin 31 through rotor lock pin passage 136 thereby urging lock pin 31 out of lock pin seat 62 and compressing a lock pin spring 222. Conversely, when lock pin 31 is desired to be seated within lock pin seat 62, oil is vented from lock pin 31 through rotor lock pin passage 136, thereby causing lock pin spring 222 to urge lock pin 31 toward back cover 22 and lock pin 31 is seated within lock pin seat 62 when rotor 20 is rotated to the predetermined rotor position relative to stator 18. Supplying and venting of pressurized oil to and from lock pin 31 is controlled by linear valve spool 30 as will be described later in greater detail.

As shown herein, biasing arrangement 32 includes advance bias spring 148 and retard bias spring 152 which each take the form of a clockspring where advance bias spring 148 applies a torque to rotary valve spool 28 in the advance direction only when rotary valve spool 28 is retarded relative to the predetermined rotary valve spool position and where retard bias spring 152 applies a torque to rotary valve spool 28 in the retard direction only when rotary valve spool 28 is advanced relative to the predetermined rotary valve spool position. Consequently, when rotary valve spool 28 is in the predetermined rotary valve position relative to stator 18, neither advance bias spring 148 nor retard bias spring 152 apply a torque to rotary valve spool 28. Alternatively, when rotary valve spool 28 is in the predetermined rotary valve spool position, advance bias spring 148 and retard bias spring 152 may apply torques to rotary valve spool 28 that are equal in magnitude but opposite in direction, thereby resulting in no net torque on rotary valve spool 28. In order for advance bias spring 148 to operate accordingly, advance bias spring 148 includes an outer advance bias spring tang 224 at the radially outer end thereof and an inner advance bias spring tang 226 at the radially inner end thereof. Similarly, retard bias spring 152 includes an outer retard bias spring tang 228 at the radially outer end thereof and an inner retard bias spring tang 230 at the radially inner end thereof. Outer advance bias spring tang 224 and outer retard bias spring tang 228 are grounded to a bias spring cover 232 which is fixed to front cover 24, and consequently advance bias spring 148 and retard bias spring 152 are grounded to stator 18 by virtue of front cover 24 being attached to stator 18. Bias spring cover 232 is substantially cup-shaped such that bias spring cover 232 includes a bias spring sidewall 234 which is annular in shape and radially surrounds advance bias spring 148 and retard bias spring 152, a bias spring cover end wall 236 that is annular in shape and extends radially inward from the end of bias spring sidewall 234 that is distal from front cover 24, and a bias spring cover attachment flange 238 that is annular in shape and extends radially outward from the end of bias spring sidewall 234 that is proximal to front cover 24. Bias spring cover end wall 236 defines a bias spring cover aperture 240 extending axially therethrough which allows a portion of actuator 156 to access linear valve spool 30. Bias spring cover attachment flange 238 is used to fix bias spring cover 232 to front cover 24, by way of non-limiting example only, using bias spring cover screws 242 which pass through bias spring cover attachment flange 238 and threadably engage front cover 24. When rotary valve spool 28 is retarded relative to the predetermined rotary valve spool position, first bias spring extension end 146 of bias spring extension 140 engages inner advance bias spring tang 226 of advance bias spring 148, thereby causing advance bias spring 148 to wind up and apply a torque to rotary valve spool 28 in the advance direction of rotation. However, when rotary valve spool 28 is retarded relative to the predetermined rotary valve spool position, inner retard bias spring tang 230 is disengaged from bias spring extension 140, and consequently retard bias spring 152 does not apply a torque to rotary valve spool 28. Conversely, when rotary valve spool 28 is advanced of the predetermined rotary valve spool position, second bias spring extension end 150 engages inner retard bias spring tang 230, thereby causing retard bias spring 152 to wind up and apply a torque to rotary valve spool 28 in the retard direction of rotation. However, when rotary valve spool 28 is advanced relative to the predetermined rotary valve spool position, inner advance bias spring tang 226 is disengaged from bias spring extension 140, and consequently advance bias spring 148 does not apply a torque to rotary valve spool 28. The function of advance bias spring 148 and retard bias spring 152 will be discussed in greater detail later.

Operation of camshaft phaser 12 will now be described with continued reference to FIGS. 1-6. In order to rotate rotor 20 to a desired rotational position relative to stator 18, rotary valve spool 28 is rotated to a complementary desired rotational position of rotary valve spool 28 relative to stator 18 which subsequently causes rotor 20 to rotate to the desired rotational position relative to stator 18 by either transferring oil from phasing advance chambers 46 to phasing retard chambers 48 (advance timing) or from phasing retard chambers 48 to phasing advance chambers 46 (retard timing). Furthermore, linear valve spool 30 is used to rotate rotary valve spool 28 to the complementary desired rotational position of rotary valve spool 28 relative to stator 18 by either supplying oil to rotary valve spool retard chambers 98 while venting oil from rotary valve spool advance chambers 96 (advance timing) or supplying oil to rotary valve spool advance chambers 96 while venting oil from rotary valve spool retard chambers 98 (retard timing).

Figure 3:
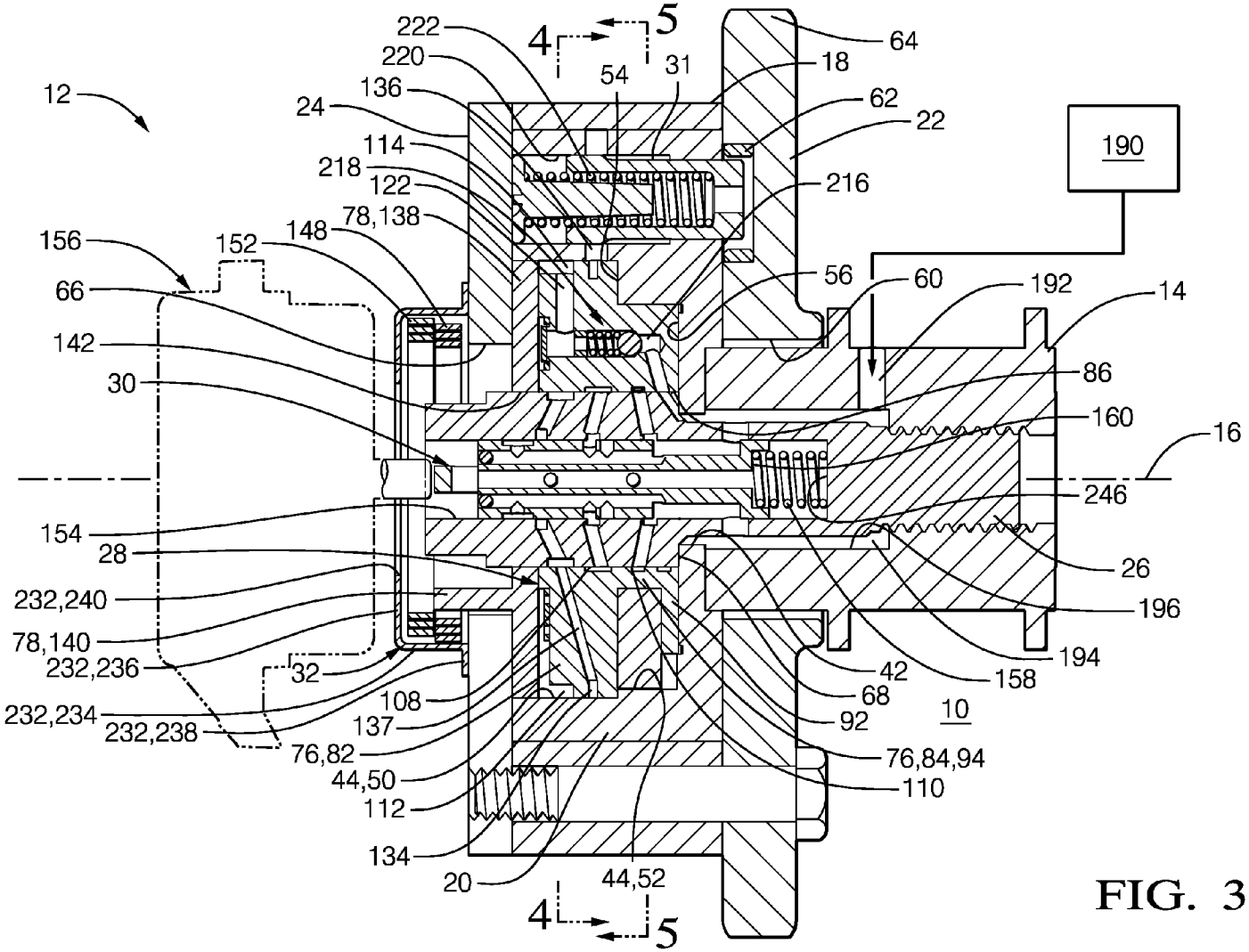
FIG. 3 is an axial cross-sectional view of the camshaft phaser of FIG. 1.
Figure 4:
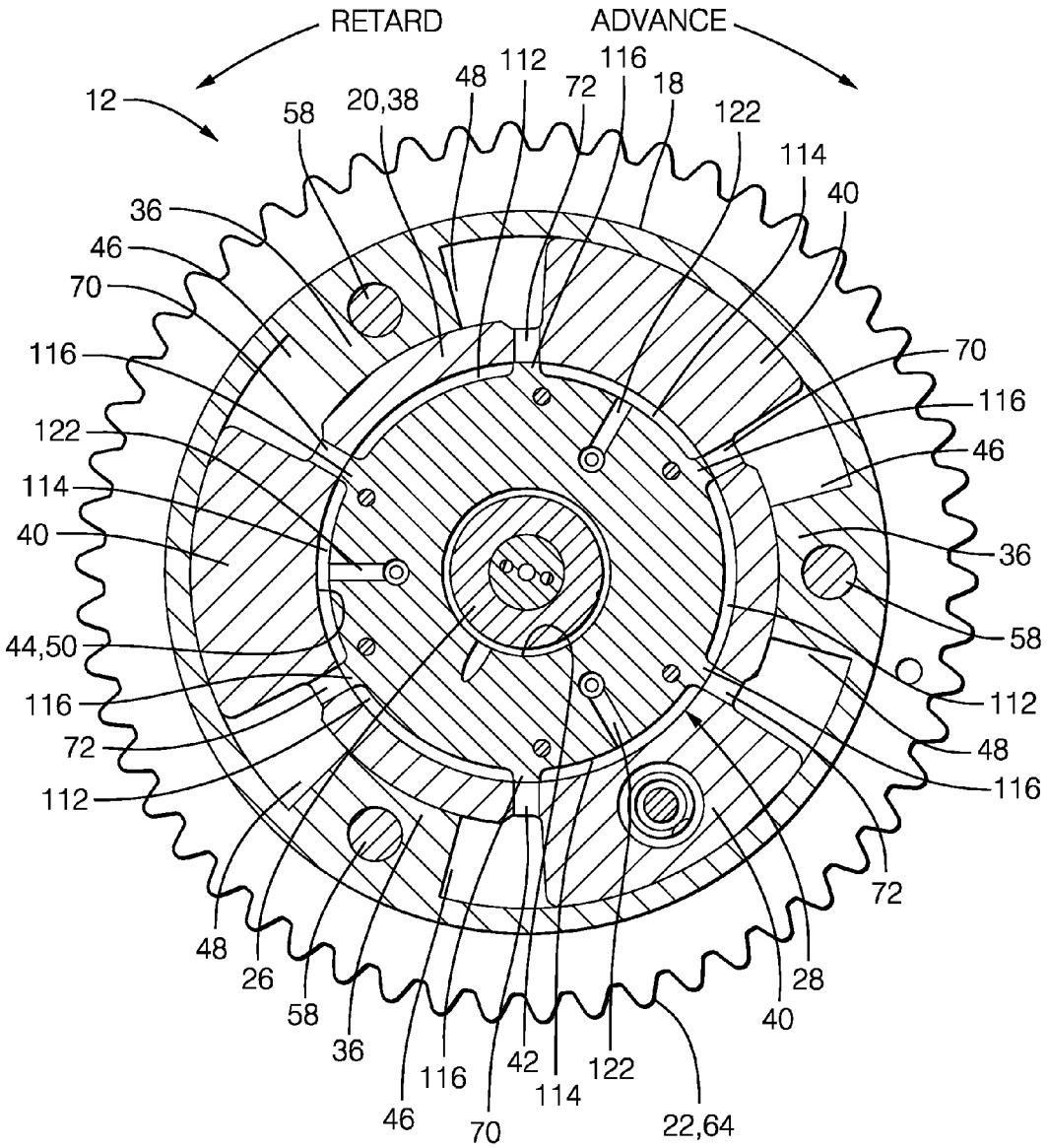
FIG. 4 is a radial cross-sectional view of the camshaft phaser of FIG. 1 taken through section line 4-4 of FIG. 3.
Figure 5:
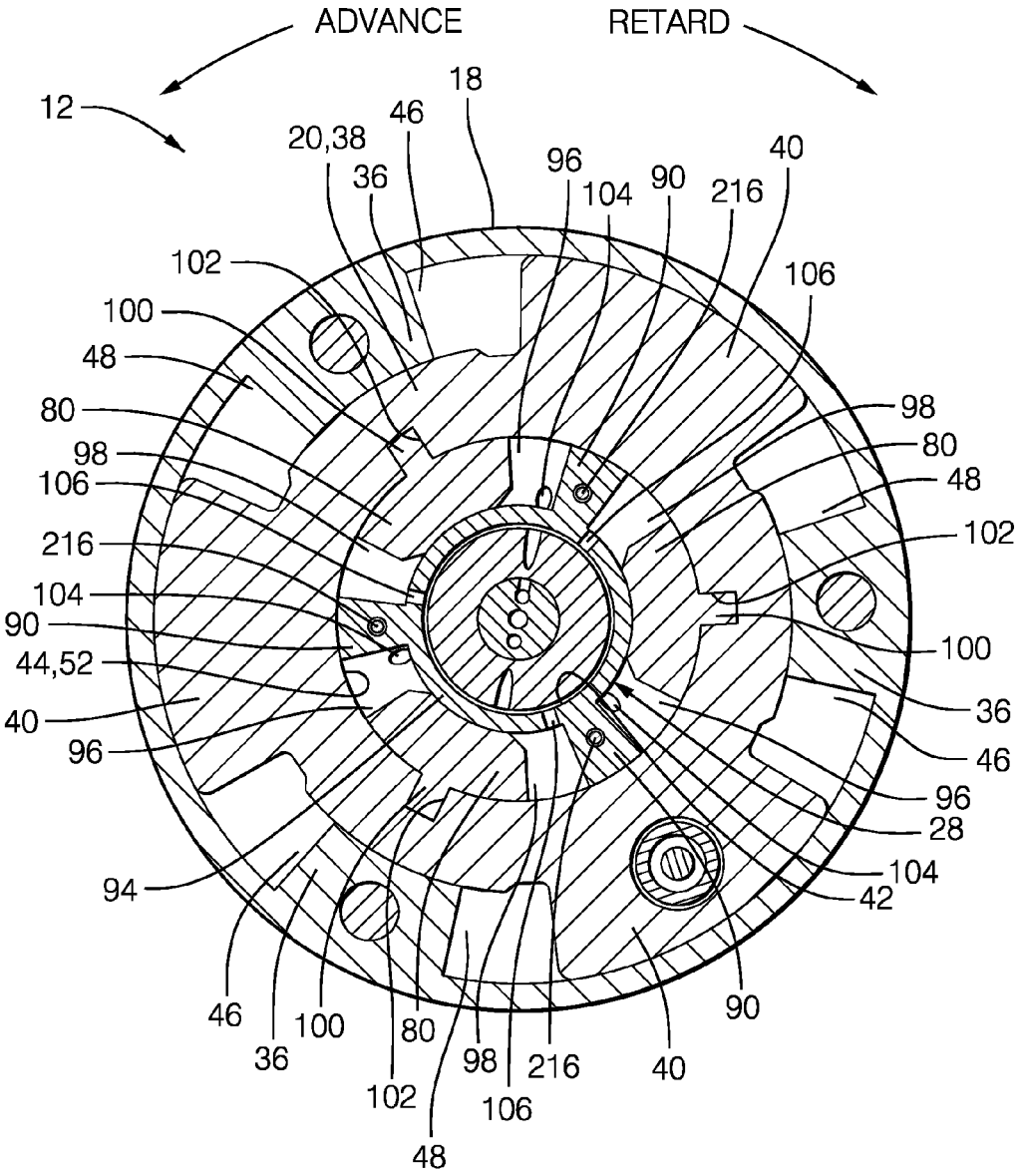
FIG. 5 is a radial cross-sectional view of the camshaft phaser of FIG. 1 taken through section line 5-5 of FIG. 3.

When it is desired to position rotor 20 relative to stator 18 in the predetermined rotor position, no electric current is applied to actuator 156, thereby allowing valve spring 158 to urge linear valve spool 30 away from the bottom of valve bore 154 until linear valve spool vent land 168 abuts a stop member 244 which may be, by way of non-limiting example only, a snap ring within a snap ring groove extending radially outward from valve bore 154. In this way, valve spring 158 positions linear valve spool 30 in a linear valve spool default position within valve bore 154 as shown in FIG. 6. In the linear valve spool default position, pressurized oil from oil source 190 is supplied to linear valve spool supply groove 162 through camshaft supply passage 192, annular supply passage 194, and bolt supply passages 188. Also in the linear valve spool default position, linear valve spool supply groove 162 is placed in fluid communication with rotary valve spool advance chambers 96 and rotary valve spool retard chambers 98 simultaneously where fluid communication between linear valve spool supply groove 162 and rotary valve spool advance chambers 96 is provided through linear valve spool axial supply passages 174, linear valve spool advance supply passages 184, linear valve spool advance supply groove 165, bolt annular advance groove 198, bolt advance passages 200, rotary valve body annular advance groove 108, and rotary valve spool advance passages 104 and where fluid communication between linear valve spool supply groove 162 and rotary valve spool retard chambers 98 is provided through bolt annular retard groove 202, bolt retard passages 204, rotary valve body annular retard groove 110, and rotary valve spool retard passages 106. Consequently, rotary valve spool advance chambers 96 and rotary valve spool retard chambers 98 are in fluid communication with each other. As a result, the torque provided by advance bias spring 148 or retard bias spring 152 will rotate rotary valve spool 28 to the predetermined rotary valve spool position which causes rotor 20 to rotate to the predetermined rotor position due to oil flow as will be described in greater detail later. More specifically, if rotor 20 is advanced of the predetermined rotor position, retard bias spring 152 will rotate rotary valve spool 28 to the predetermined rotary valve spool position. Conversely, if rotor 20 is retarded of the predetermined rotor position, advance bias spring 148 will rotate rotary valve spool 28 to the predetermined rotary valve spool position. Also in the linear valve spool default position, lock pin 31 is placed in fluid communication with linear valve spool axial vent passage 172 as shown in FIGS. 3 and 6, thereby allowing oil to drain from lock pin 31 and also allowing lock pin spring 222 to urge lock pin 31 toward back cover 22 and into lock pin seat 62 after rotor 20 has been rotated to the predetermined rotor position as a result of rotary valve spool 28 being rotated to the predetermined rotary valve spool position by advance bias spring 148 or retard bias spring 152. Fluid communication from lock pin 31 to linear valve spool axial vent passage 172 is provided through rotor lock pin passage 136, annular rotary valve body lock pin groove 134, rotary valve spool lock pin passage 137, bolt outer annular lock pin groove 208, bolt lock pin passages 210, bolt inner annular lock pin groove 206, and second linear valve spool radial vent passage 180, thereby allowing oil to drain out of valve bore 154 and back to oil source 190.

Figure 7A:
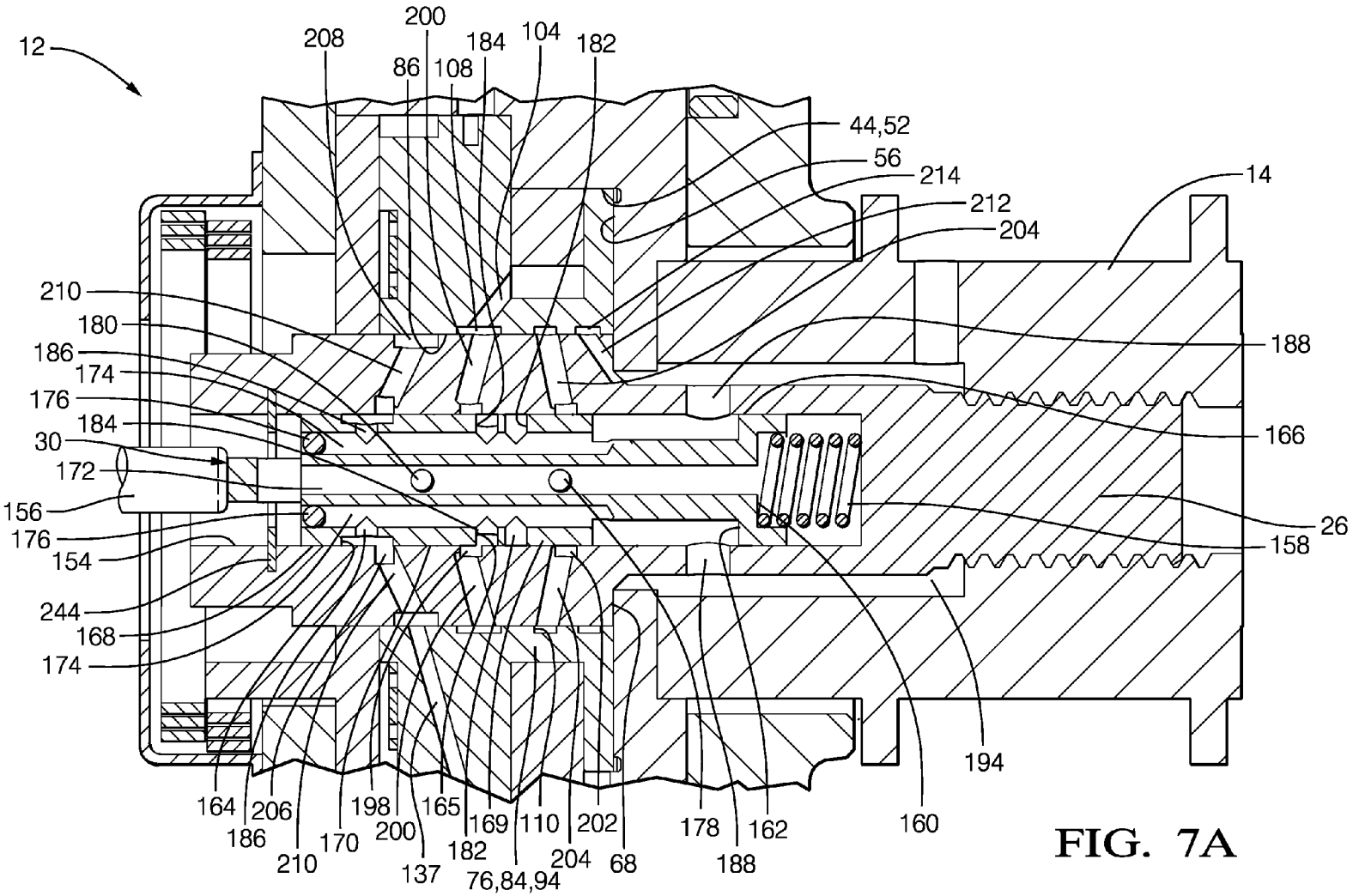
FIG. 7A is the axial cross-sectional view of FIG. 6 now with the linear valve spool shown in a retard position.
Figure 7B:
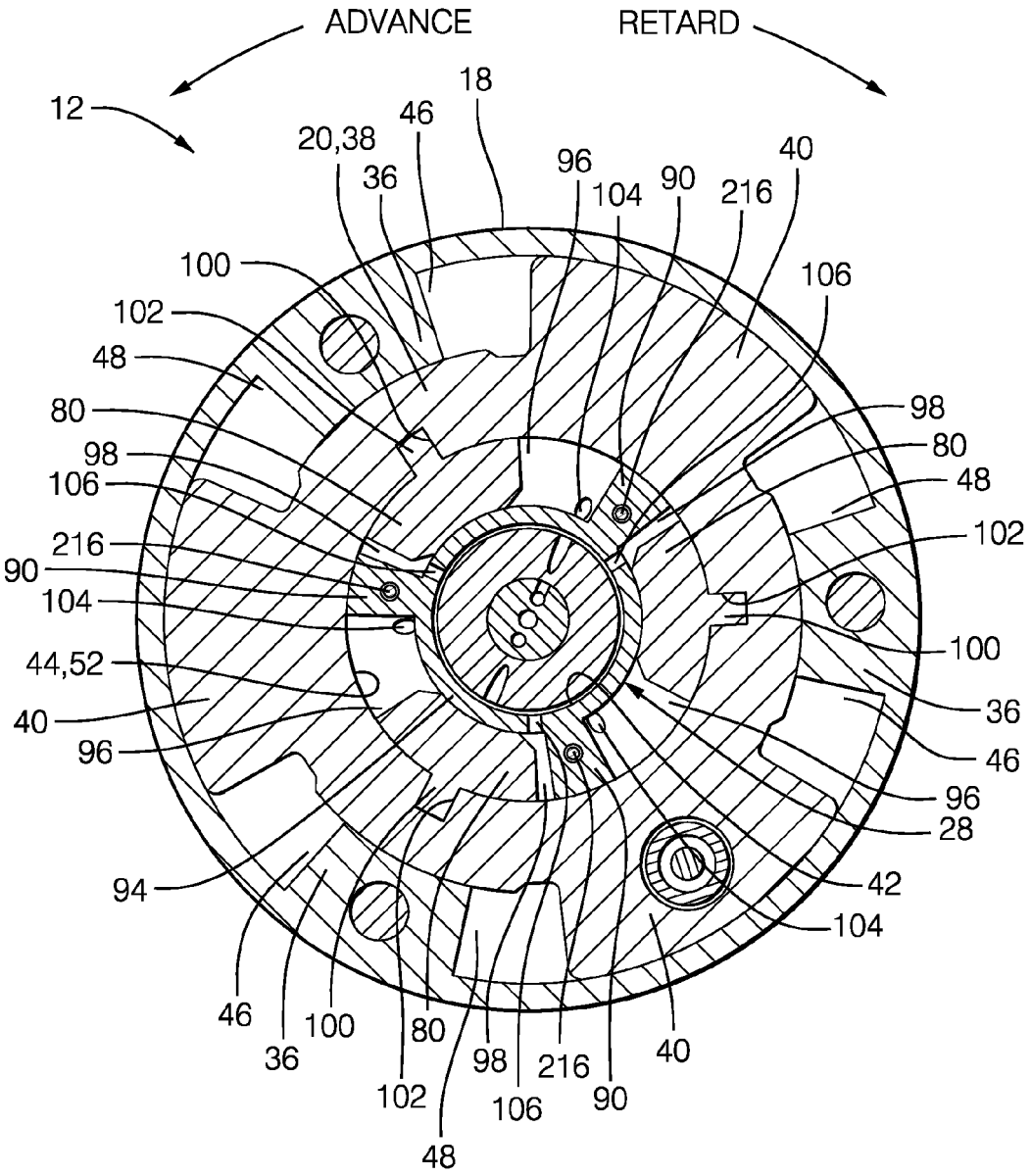
FIG. 7B is the radial cross-sectional view of FIG. 4 showing the rotary valve spool after being rotated as a result of the linear valve spool position of FIG. 7A.
Figure 7C:
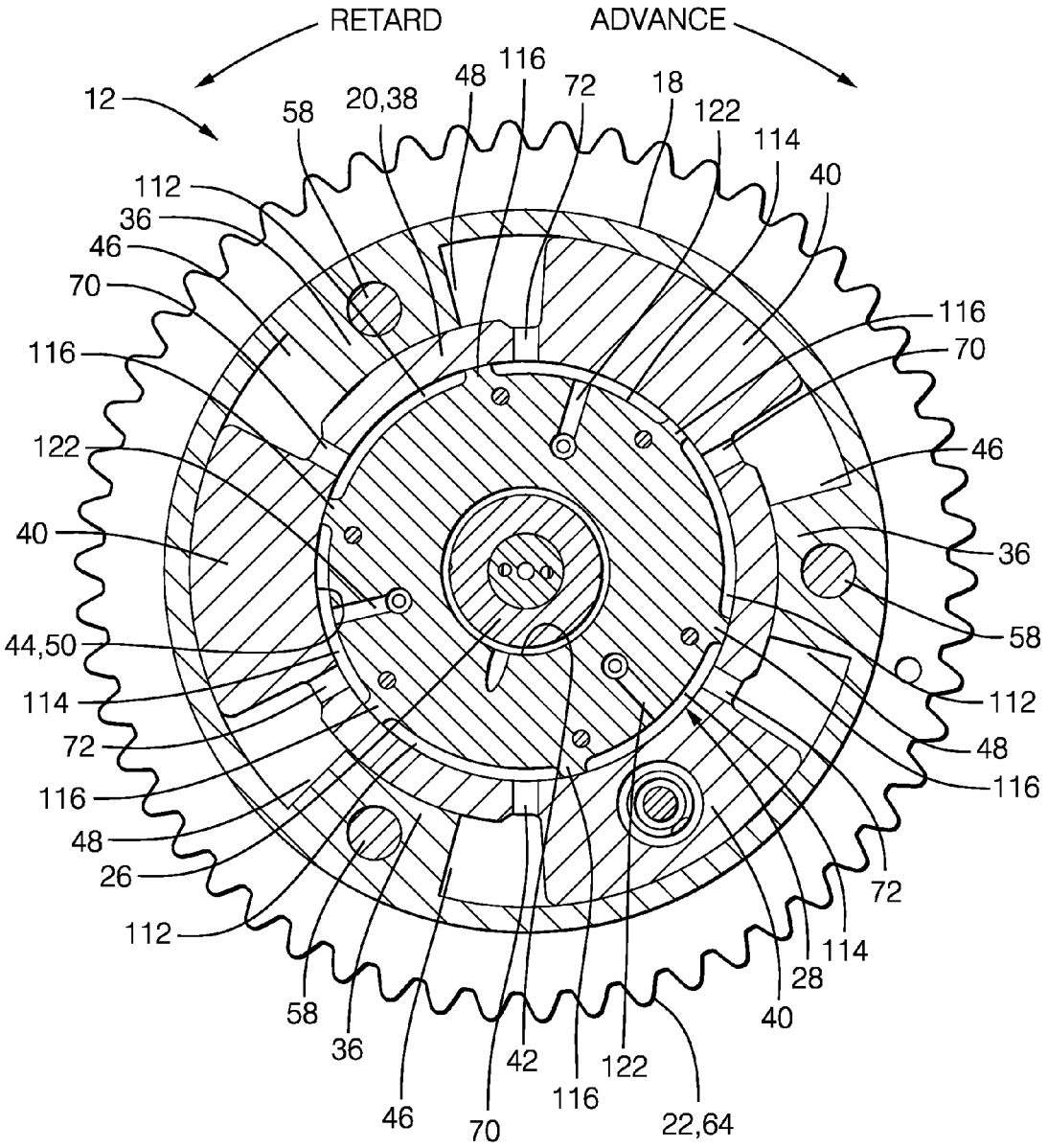
FIG. 7C is the radial cross-sectional view of FIG. 5 showing the rotary valve spool after being rotated as a result of the linear valve spool position of FIG. 7A.
Figure 7D:
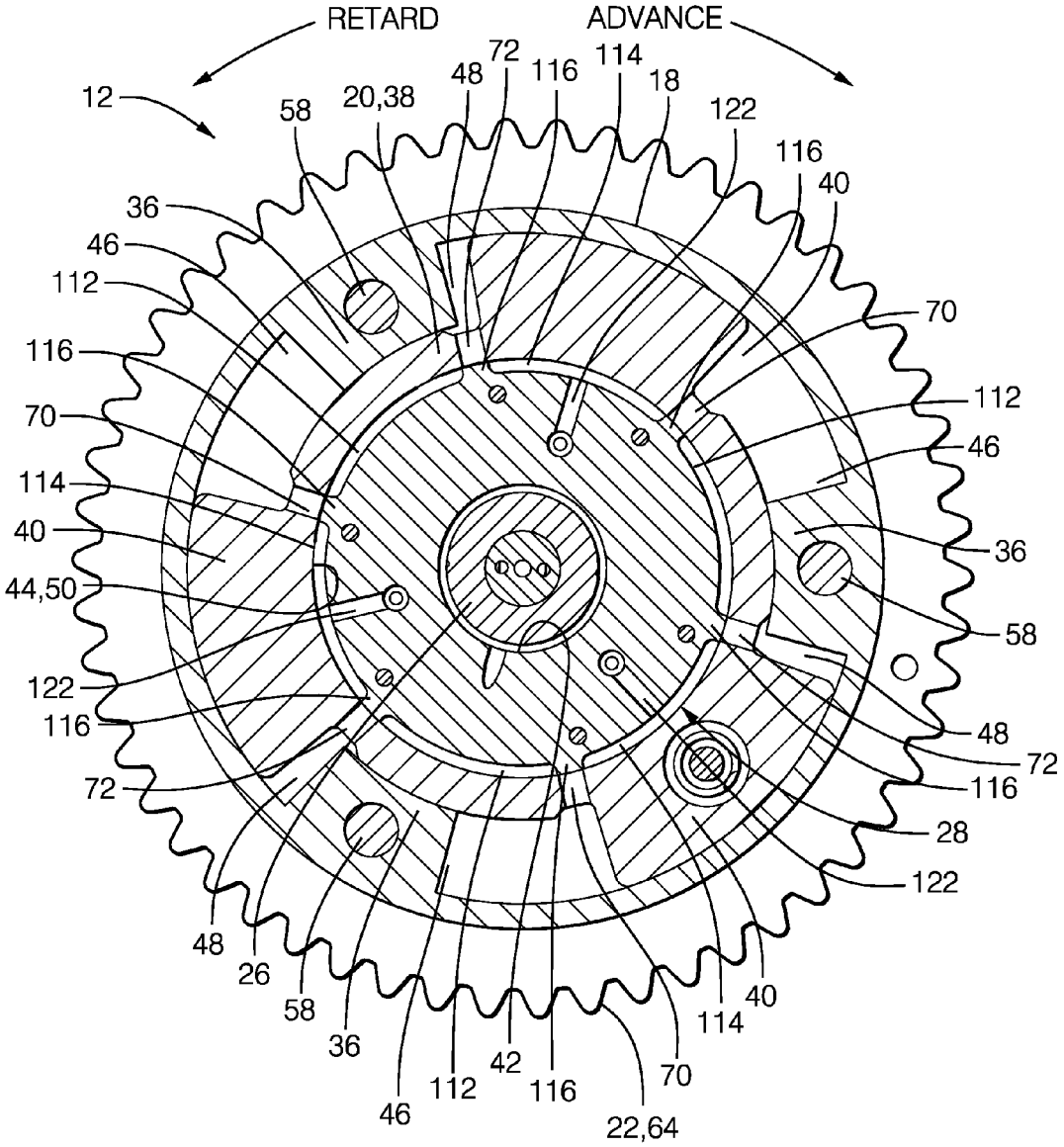
FIG. 7D is the radial cross-sectional view of FIG. 7C showing the rotor after being rotated as a result of the position of the rotary valve spool as shown in FIG. 7C.
Figure 7E:
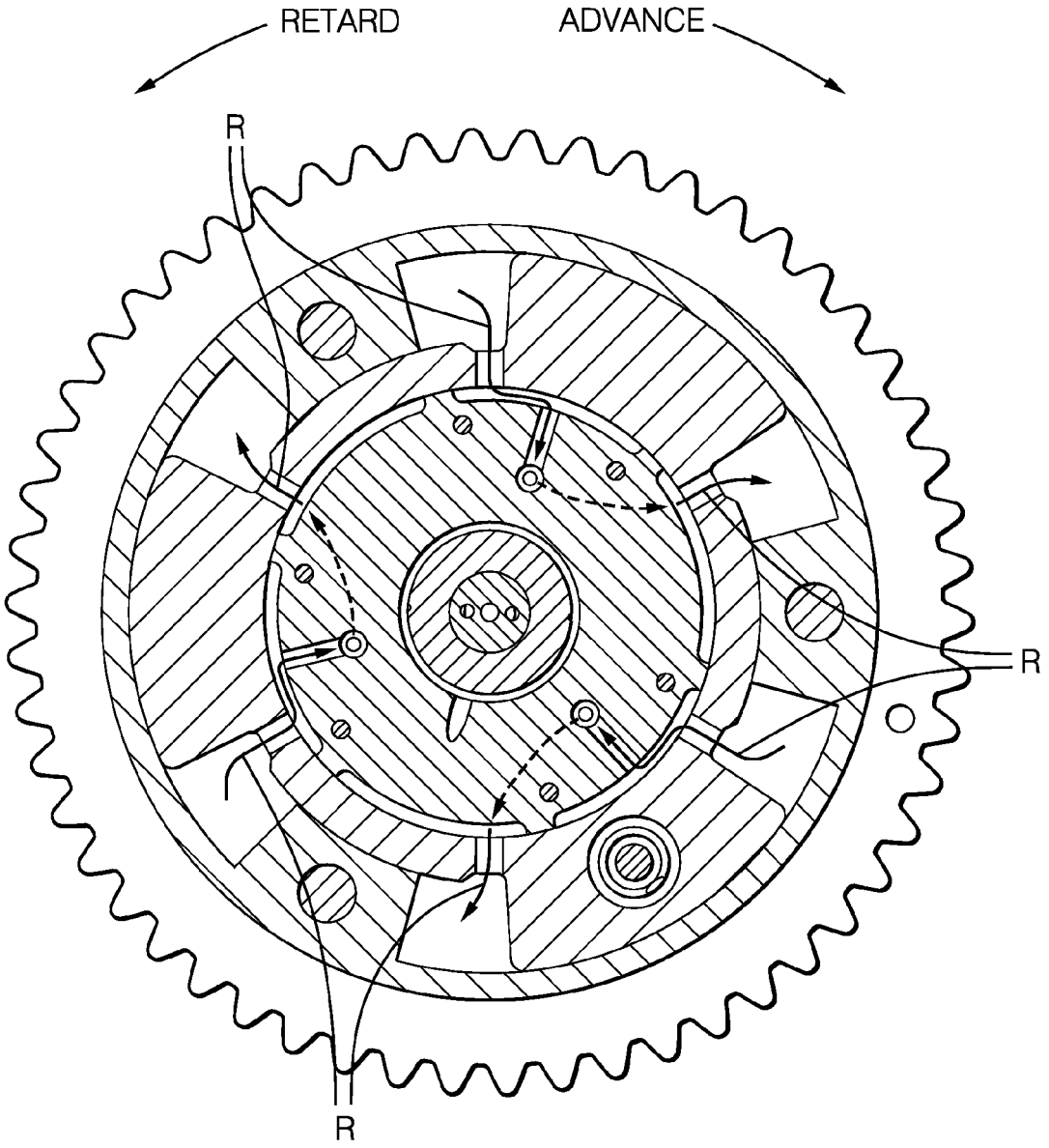
FIG. 7E is the radial cross-sectional view of FIG. 7C with reference numbers removed in order to clearly shown the path of oil flow as a result of the position of the rotary valve spool as shown in FIG. 7C.

Reference will continue to be made to FIGS. 1-5 and additional reference will now be made to FIGS. 7A-7E. When it is desired to retard the rotational position of rotor 20 relative to stator 18, an electric current of a first magnitude is applied to actuator 156, thereby causing actuator 156 to urge linear valve spool 30 toward the bottom of valve bore 154 slightly, thereby compressing valve spring 158 slightly. In this way, actuator 156 positions linear valve spool 30 in a linear valve spool retard position within valve bore 154 as shown in FIG. 7A. In the linear valve spool retard position, rotary valve spool retard chambers 98 are placed in fluid communication with linear valve spool axial vent passage 172 while rotary valve spool advance chambers 96 are placed in fluid communication with linear valve spool supply groove 162, thereby causing oil to flow out of rotary valve spool retard chambers 98 while allowing oil to flow into rotary valve spool advance chambers 96 from oil source 190 and also causing rotary valve spool 28 to rotate in the retard direction of rotation as shown in FIGS. 7B and 7C. More specifically, rotary valve spool retard chambers 98 are placed in fluid communication with linear valve spool axial vent passage 172 through rotary valve spool retard passages 106, rotary valve body annular retard groove 110, bolt retard passages 204, bolt annular retard groove 202, and first linear valve spool radial vent passage 178 while rotary valve spool advance chambers 96 are placed in fluid communication with linear valve spool supply groove 162 through linear valve spool axial supply passages 174, linear valve spool advance supply passage 184, linear valve spool advance supply groove 165, bolt annular advance groove 198, bolt advance passages 200, rotary valve body annular advance groove 108, and rotary valve spool advance passages 104. Also in the linear valve spool retard position, lock pin 31 is placed in fluid communication with linear valve spool supply groove 162, thereby causing pressurized oil to be supplied to lock pin 31 from oil source 190 and also causing lock pin 31 to retract from lock pin seat 62. More specifically, lock pin 31 is placed in fluid communication with linear valve spool supply groove 162 through linear valve spool axial supply passages 174, linear valve spool lock pin supply passage 186, linear valve spool lock pin supply groove 164, bolt inner annular lock pin groove 206, bolt lock pin passages 210, bolt outer annular lock pin groove 208, rotary valve spool lock pin passage 137, annular rotary valve body lock pin groove 134, and rotor lock pin passage 136. When rotary valve spool 28 is rotated in the retard direction relative to stator 18, rotary valve spool lands 116 are moved out of alignment with rotor advance passages 70 and rotor retard passages 72, thereby providing fluid communication between supply chambers 112 and phasing advance chambers 46 and also between vent chambers 114 and phasing retard chambers 48. Consequently, torque reversals of camshaft 14 which tend to pressurize oil within phasing retard chambers 48 cause oil to be communicated from phasing retard chambers 48 to phasing advance chambers 46 via rotor retard passages 72, vent chambers 114, rotary valve spool recirculation passages 122, annular rotary valve spool recirculation groove 118, recirculation recesses 120, supply chambers 112, and rotor advance passages 70. However, torque reversals of camshaft 14 which tend to pressurize oil within phasing advance chambers 46 and apply a torque to rotor 20 in the advance direction are prevented from venting oil from phasing advance chambers 46 because recirculation check valves 74 prevent oil from flowing from phasing advance chambers 46 to phasing retard chambers 48. Oil continues to be supplied to phasing advance chambers 46 from phasing retard chambers 48 until rotor 20 is rotationally displaced sufficiently far for each rotary valve spool land 116 to again align with respective rotor advance passages 70 and rotor retard passages 72 as shown in FIG. 7D, thereby again preventing fluid communication into and out of phasing advance chambers 46 and phasing retard chambers 48 and hydraulically locking the rotational position of rotor 20 relative to stator 18. In FIG. 7E, which is the same cross-sectional view as FIG. 7C, the reference numbers have been removed for clarity, and arrows R have been included to represent oil that is being recirculated for rotating rotor 20 relative to stator 18. It should be noted that arrow R in FIG. 7E is shown in dotted lines where the flow is in a different plane than FIG. 7E and more particularly, where the flow is through annular rotary valve spool recirculation groove 118 and rotary valve spool recirculation passages 122. It should be noted that the flow of oil from phasing retard chambers 48 to phasing advance chambers 46 as described relative to the linear valve spool retard position is the same as when retard bias spring 152 is used to rotate rotary valve spool 28 to the predetermined rotary valve spool position when linear valve spool 30 is in the linear valve spool default position.

Figure 8:
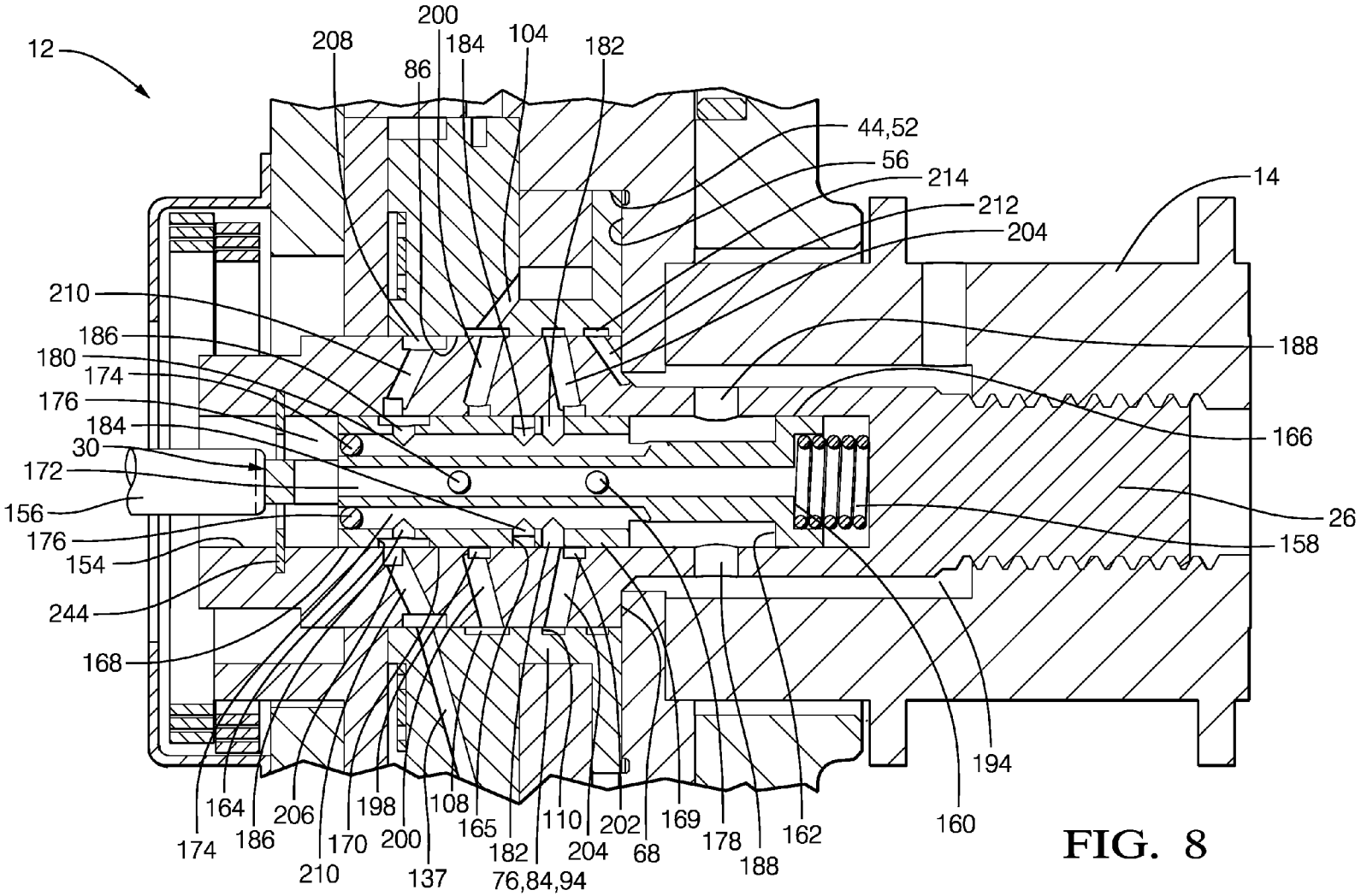
FIG. 8 is the an axial cross-sectional view of FIG. 6 with the linear valve spool of the camshaft phaser in a hold position.

Reference will continue to be made to FIGS. 1-5 and additional reference will now be made to FIG. 8. When no change in phase relationship between camshaft 14 and the crankshaft of internal combustion engine 10 is desired, an electric current of a second magnitude is applied to actuator 156, thereby causing actuator 156 to urge linear valve spool 30 toward the bottom of valve bore 154 slightly more than in the retard linear valve spool position, thereby compressing valve spring 158 slightly more than in the linear valve spool retard position. In this way, actuator 156 positions linear valve spool 30 in a linear valve spool hold position within valve bore 154 as shown in FIG. 8. In the linear valve spool hold position, fluid communication into and out of rotary valve spool advance chambers 96 and rotary valve spool retard chambers 98 is blocked by linear valve spool retard land 169 and linear valve spool advance land 170 respectively, thereby hydraulically locking rotary valve spool 28 and preventing relative rotation between rotary valve spool 28 and between rotor 20 and stator 18. Also in the linear valve spool hold position, lock pin 31 is placed in fluid communication with linear valve spool supply groove 162, thereby causing pressurized oil to be supplied to lock pin 31 from oil source 190 and also causing lock pin 31 to retract from lock pin seat 62. More specifically, lock pin 31 is placed in fluid communication with linear valve spool supply groove 162 through linear valve spool axial supply passages 174, linear valve spool lock pin supply passage 186, linear valve spool lock pin supply groove 164, bolt inner annular lock pin groove 206, bolt lock pin passages 210, bolt outer annular lock pin groove 208, rotary valve spool lock pin passage 137, annular rotary valve body lock pin groove 134, and rotor lock pin passage 136.

Figure 9A:
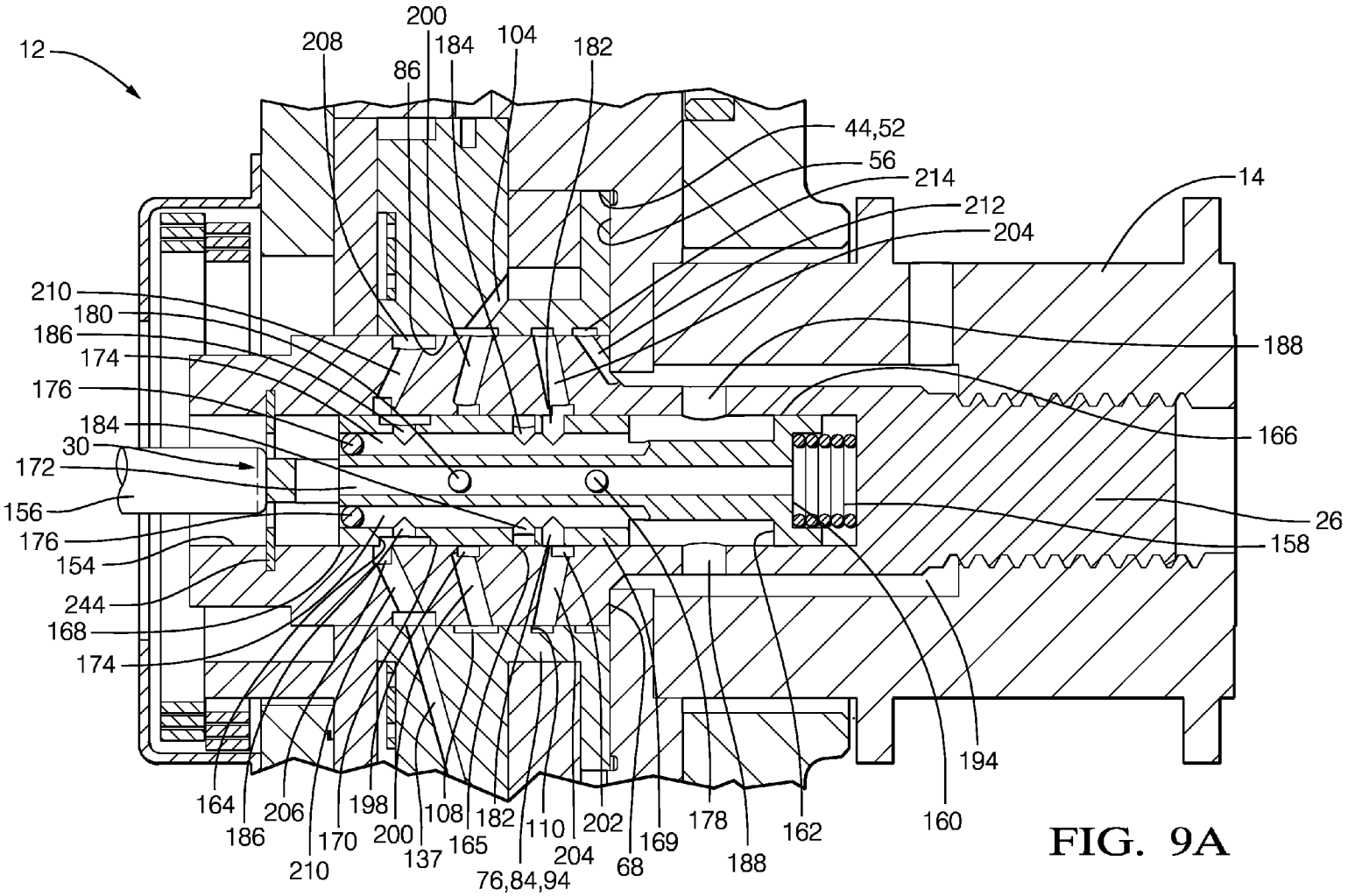
FIG. 9A is the axial cross-sectional view of FIG. 6 now with the linear valve spool shown in an advance position.
Figure 9B:
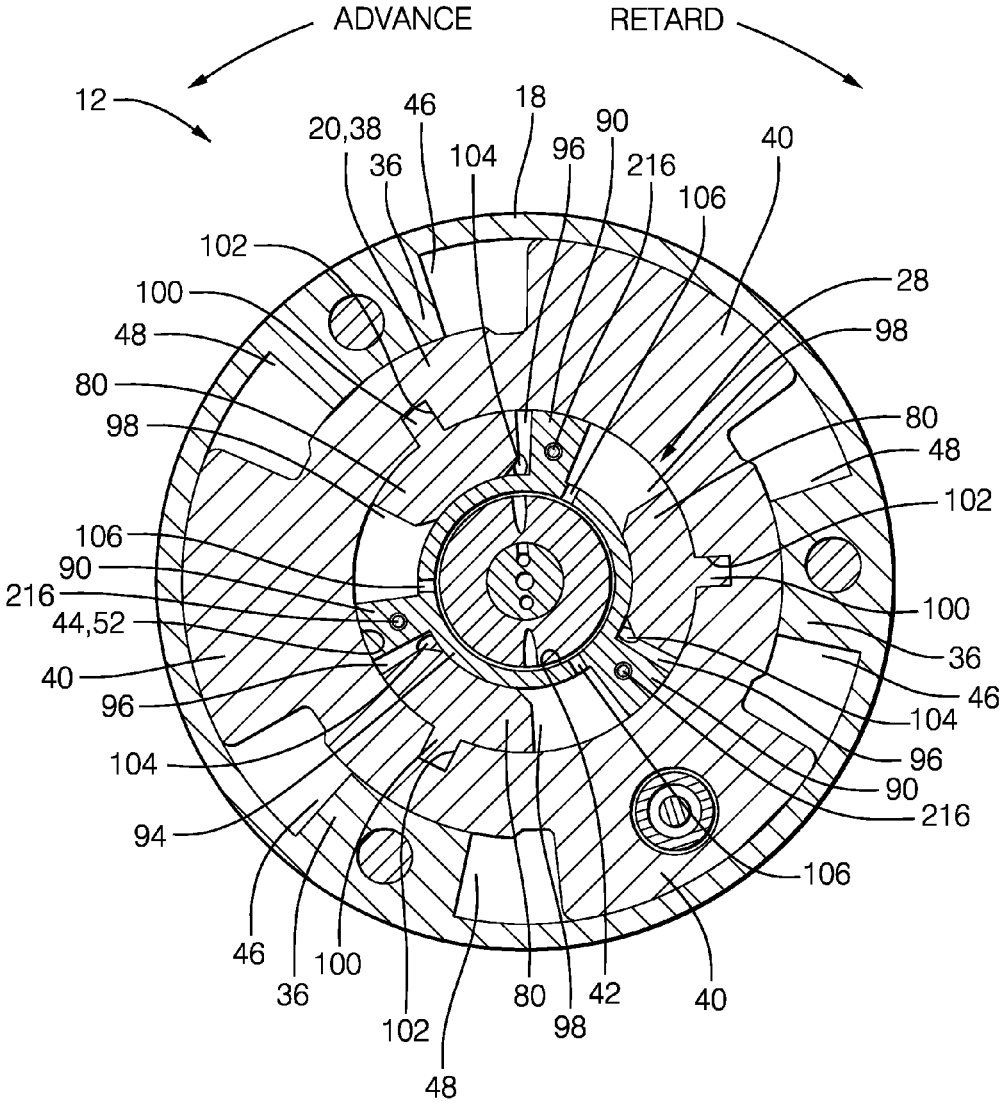
FIG. 9B is the radial cross-sectional view of FIG. 4 showing the rotary valve spool after being rotated as a result of the linear valve spool position of FIG. 9A.
Figure 9C:
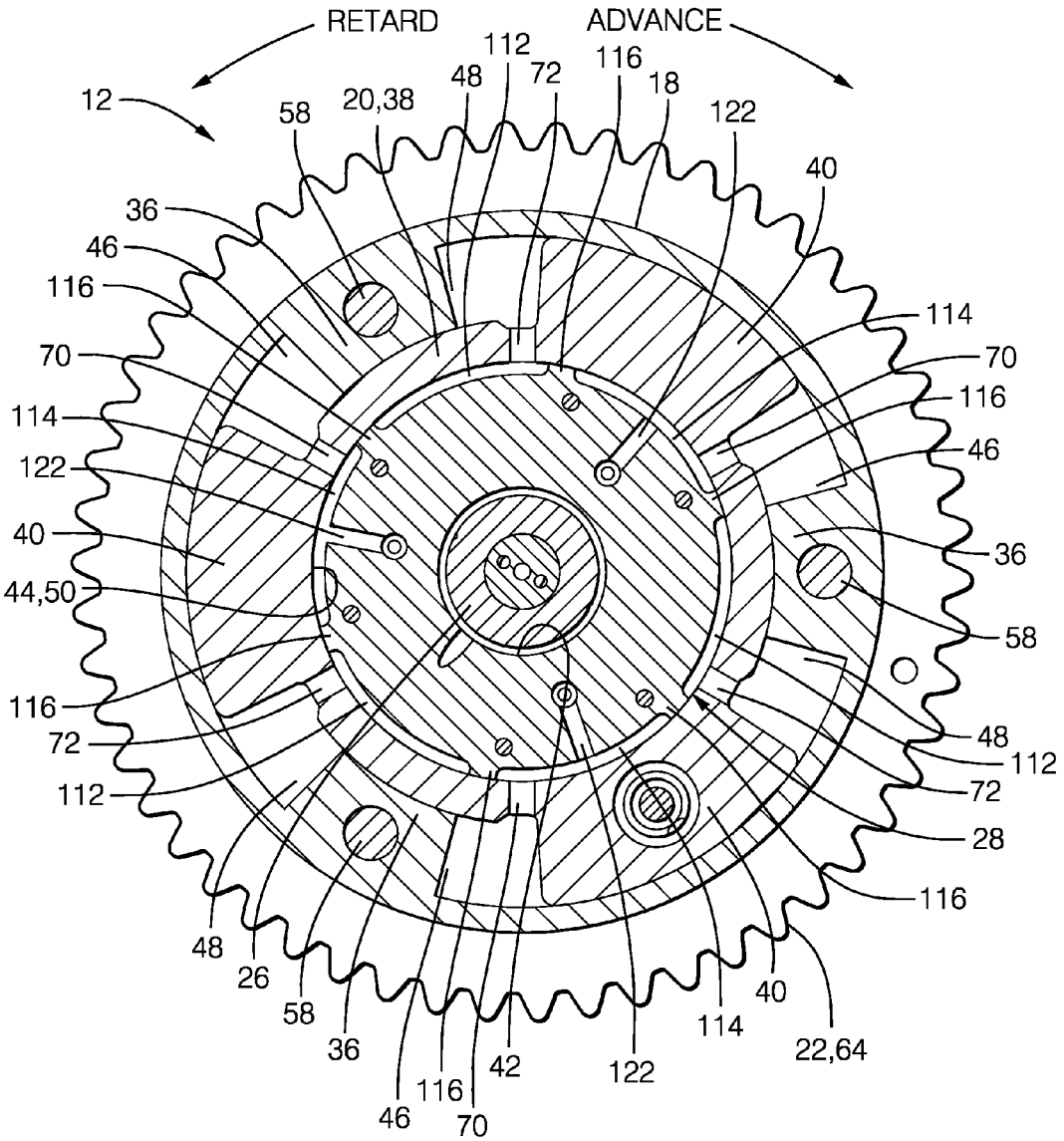
FIG. 9C is the radial cross-sectional view of FIG. 5 showing the rotary valve spool after being rotated as a result of the linear valve spool position of FIG. 9A.
Figure 9D:
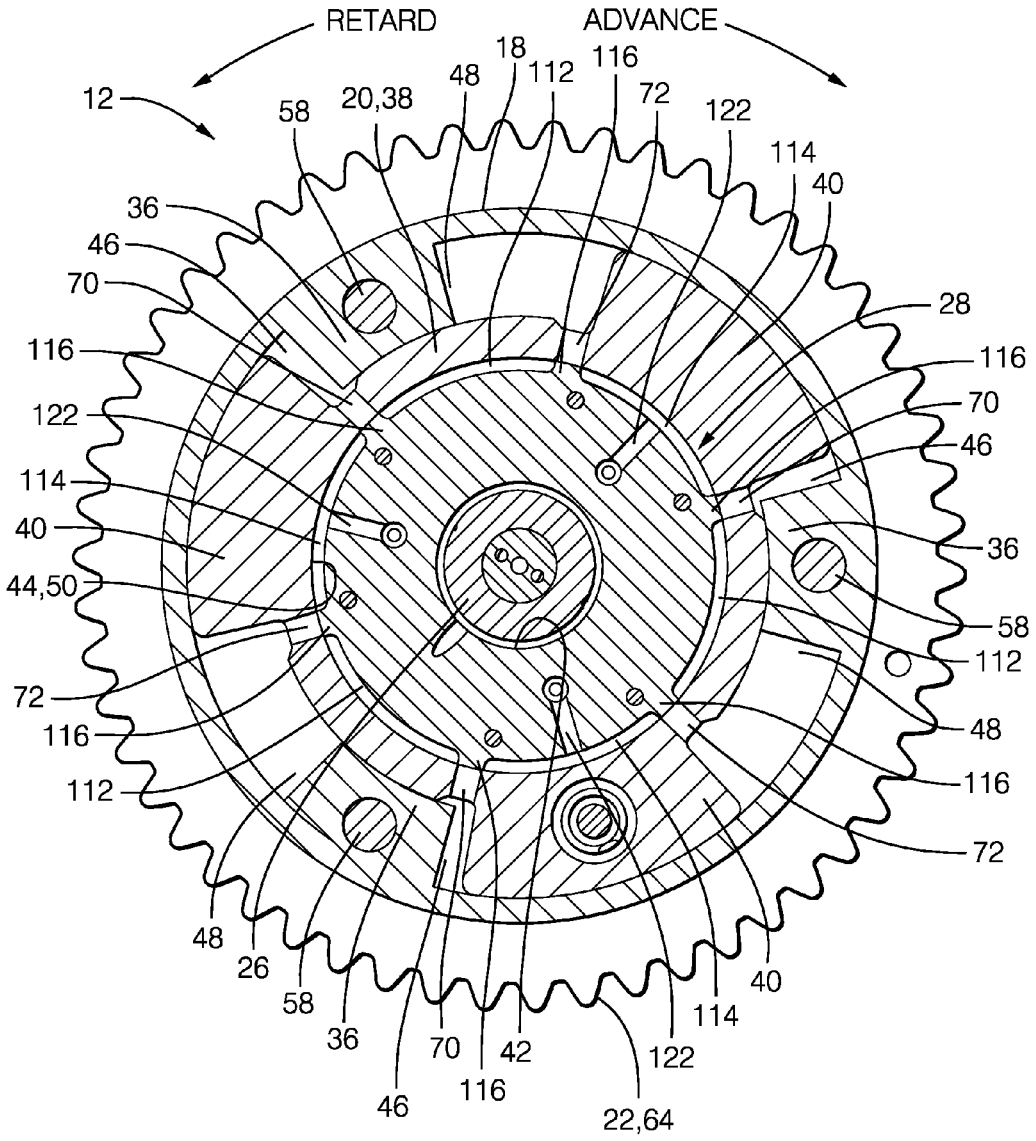
FIG. 9D is the radial cross-sectional view of FIG. 9C showing the rotor after being rotated as a result of the position of the rotary valve spool as shown in FIG. 9C.
Figure 9E:
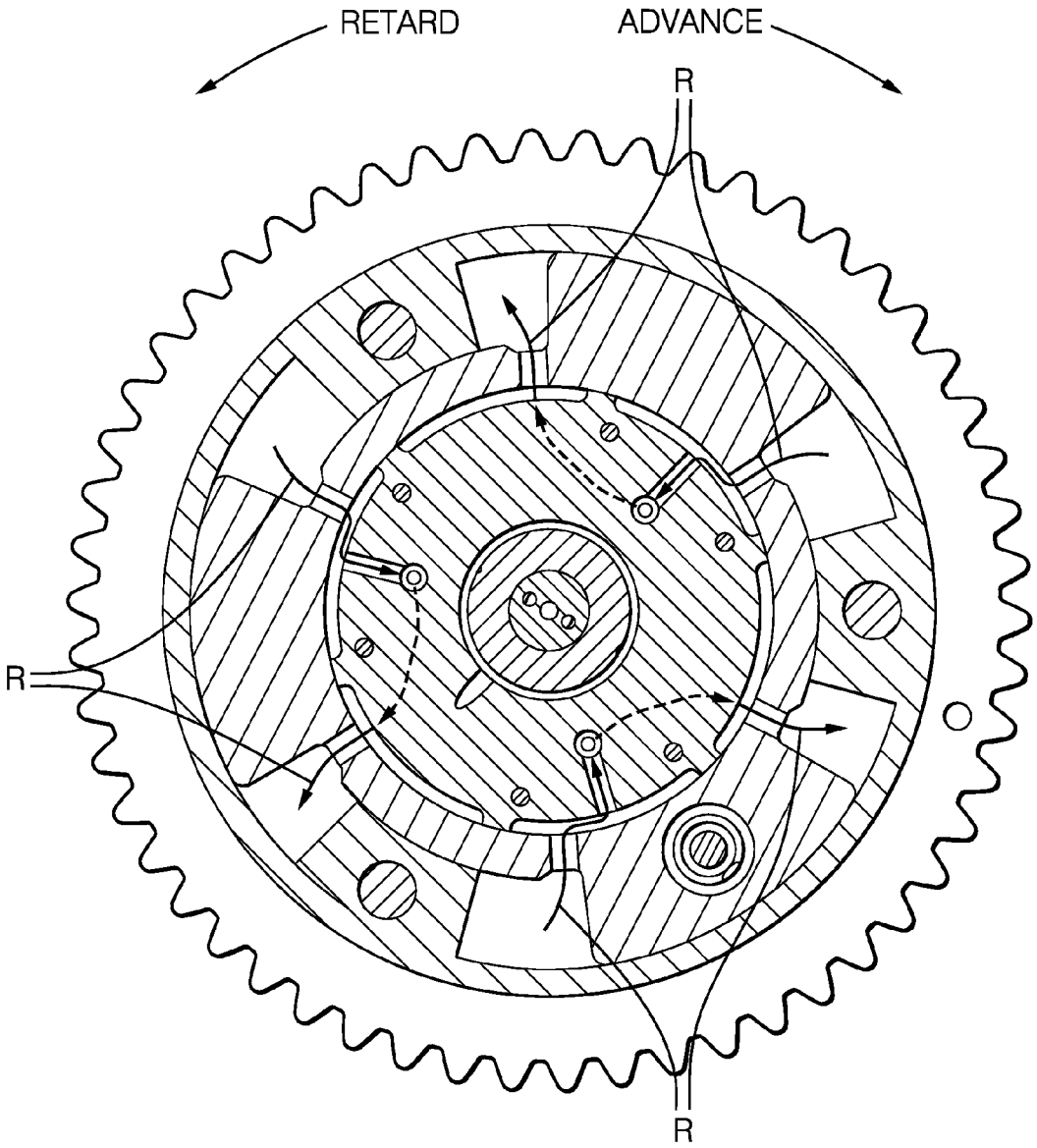
FIG. 9E is the radial cross-sectional view of FIG. 9C with reference numbers removed in order to clearly shown the path of oil flow as a result of the position of the rotary valve spool as shown in FIG. 9C.

Reference will continue to be made to FIGS. 1-5 and additional reference will now be made to FIGS. 9A-9E. When it is desired to advance the rotational position of rotor 20 relative to stator 18, an electric current of a third magnitude is applied to actuator 156, thereby causing actuator 156 to urge linear valve spool 30 toward the bottom of valve bore 154 slightly more than in the linear valve spool hold position, thereby compressing valve spring 158 slightly more than in the linear valve spool hold position. In this way, actuator 156 positions linear valve spool 30 in a linear valve spool advance position within valve bore 154 as shown in FIG. 9A. In the linear valve spool advance position, rotary valve spool advance chambers 96 are placed in fluid communication with linear valve spool axial vent passage 172 while rotary valve spool retard chambers 98 are placed in fluid communication with linear valve spool supply groove 162, thereby causing oil to flow out of rotary valve spool advance chambers 96 while allowing oil to flow into rotary valve spool retard chambers 98 from oil source 190 and also causing rotary valve spool 28 to rotate in the advance direction of rotation as shown in FIGS. 9B and 9C. More specifically, rotary valve spool advance chambers 96 are placed in fluid communication with linear valve spool axial vent passage 172 through rotary valve spool advance passages 104, rotary valve body annular advance groove 108, bolt advance passages 200, bolt annular advance groove 198, and second linear valve spool radial vent passage 180 while rotary valve spool retard chambers 98 are placed in fluid communication with linear valve spool supply groove 162 through linear valve spool axial supply passages 174, linear valve spool retard supply passages 182, bolt annular retard groove 202, bolt retard passages 204, rotary valve body annular retard groove 110, and rotary valve spool retard passages 106. Also in the linear valve spool advance position, lock pin 31 is placed in fluid communication with linear valve spool supply groove 162, thereby causing pressurized oil to be supplied to lock pin 31 from oil source 190 and also causing lock pin 31 to retract from lock pin seat 62. More specifically, lock pin 31 is placed in fluid communication with linear valve spool supply groove 162 through linear valve spool axial supply passages 174, linear valve spool lock pin supply passage 186, linear valve spool lock pin supply groove 164, bolt inner annular lock pin groove 206, bolt lock pin passages 210, bolt outer annular lock pin groove 208, rotary valve spool lock pin passage 137, annular rotary valve body lock pin groove 134, and rotor lock pin passage 136. When rotary valve spool 28 is rotated in the advance direction relative to stator 18, rotary valve spool lands 116 are moved out of alignment with rotor advance passages 70 and rotor retard passages 72, thereby providing fluid communication between supply chambers 112 and phasing retard chambers 48 and also between vent chambers 114 and phasing advance chambers 46. Consequently, torque reversals of camshaft 14 which tend to pressurize oil within phasing advance chambers 46 cause oil to be communicated from phasing advance chambers 46 to phasing retard chambers 48 via rotor advance passages 70, vent chambers 114, rotary valve spool recirculation passages 122, annular rotary valve spool recirculation groove 118, recirculation recesses 120, supply chambers 112, and rotor retard passages 72. However, torque reversals of camshaft 14 which tend to pressurize oil within phasing retard chambers 48 and apply a torque to rotor 20 in the retard direction are prevented from venting oil from phasing retard chambers 48 because recirculation check valves 74 prevent oil from flowing from phasing retard chambers 48 to phasing advance chambers 46. Oil continues to be supplied to phasing retard chambers 48 from phasing advance chambers 46 until rotor 20 is rotationally displaced sufficiently far for each rotary valve spool land 116 to again align with respective rotor advance passages 70 and rotor retard passages 72 as shown in FIG. 9D, thereby again preventing fluid communication into and out of phasing advance chambers 46 and phasing retard chambers 48 and hydraulically locking the rotational position of rotor 20 relative to stator 18. In FIG. 9E, which is the same cross-sectional view as FIG. 9C, the reference numbers have been removed for clarity, and arrows R have been included to represent oil that is being recirculated for rotating rotor 20 relative to stator 18. It should be noted that arrow R in FIG. 9E is shown in dotted lines where the flow is in a different plane than FIG. 7E and more particularly, where the flow is through annular rotary valve spool recirculation groove 118 and rotary valve spool recirculation passages 122. It should be noted that the flow of oil from phasing advance chambers 46 to phasing retard chambers 48 as described relative to the linear valve spool advance position is the same as when advance bias spring 148 is used to rotate rotary valve spool 28 to the predetermined rotary valve spool position when linear valve spool 30 is in the default linear valve spool position.

It should be noted that oil that may leak from phasing advance chambers 46, phasing retard chambers 48, or passages and interfaces associated therewith is replenished from oil provided by oil source 190. Replenishing oil is accomplished by oil source 190 supplying oil to annular rotary valve spool recirculation groove 118 via camshaft supply passage 192, annular supply passage 194, bolt make-up oil passages 212, rotary valve body make-up groove 214, rotary valve body make-up passages 216, make-up check valve 218, and rotary valve spool recirculation passages 122. From annular rotary valve spool recirculation groove 118, the oil may be supplied to phasing advance chambers 46 or phasing retard chambers 48 as necessary by one or more of the processes described previously for advancing or retarding rotor 20.

It is important to note that oil exclusively flows from supply chambers 112 to whichever of phasing advance chambers 46 and phasing retard chambers 48 need to increase in volume in order to achieve the desired phase relationship of rotor 20 relative to stator 18 while oil exclusively flows to vent chambers 114 from whichever of phasing advance chambers 46 and phasing retard chambers 48 need to decrease in volume in order to achieve the desired phase relationship of rotor 20 relative to stator 18. In this way, only one set of recirculation check valves 74 are needed acting in one direction within rotary valve spool 28 in order to achieve the desired phase relationship of rotor 20 relative to stator 18. Consequently, it is not necessary to switch between sets of check valves operating in opposite flow directions or switch between an advancing circuit and a retarding circuit. In the case of rotary valve spool 28 described herein, a unidirectional flow circuit is defined within rotary valve spool 28 when rotary valve spool 28 is moved to a position within rotor 20 to allow either flow from phasing advance chambers 46 to phasing retard chambers 48 or from phasing retard chambers 48 to phasing advance chambers 46 where the flow circuit prevents flow in the opposite directions. Consequently, the flow circuit is defined by rotary valve spool 28 which is simple in construction and low cost to produce.

While clockwise rotation of rotor 20 relative to stator 18 has been described as advancing camshaft 14 and counterclockwise rotation of rotor 20 relative to stator 18 has been described as retarding camshaft 14, it should now be understood that this relationship may be reversed depending on whether camshaft phaser 12 is mounted to the front of internal combustion engine 10 (shown in the figures) or to the rear of internal combustion engine 10.

While recirculation check valves 74 have been illustrated as reed valves, it should now be understood that recirculation check valves 74 can take other forms commonly know, by way of non-limiting example only, a ball biased by a coil spring. Furthermore, recirculation check valves 74 can be placed in locations other than embodied herein. Also furthermore, a single recirculation check valve 74 may be used when all supply chambers 112 or all vent chambers 114 are in communication with a common passage.

Using oil supplied to and vented from rotary valve spool advance chambers 96 and rotary valve spool retard chambers 98 to rotate rotary valve spool 28 allows for many monitored parameters of internal combustion engine 10 to be used for determining the desired phase relationship because the many monitor parameters can be processed and used to command linear valve spool 30 which controls the supply and venting of oil to and from rotary valve spool advance chambers 96 and rotary valve spool retard chambers 98 to rotate rotary valve spool 28. Using oil supplied to and vented from rotary valve spool advance chambers 96 and rotary valve spool retard chambers 98 to rotate rotary valve spool 28 also allows implementation of biasing arrangement 32 to rotate rotary valve spool 28 to a position that will allow rotor 20 to rotate to a predetermined rotor position within stator 18. Since biasing arrangement 32 only needs to rotate rotary valve spool 28, rather than rotor 20 directly, advance bias spring 148 and retard bias spring 152 can have low spring rates compared to bias springs typically implemented in camshaft phasers which must rotate the rotor directly. This arrangement provides a means for rotor 20 to move to the predetermined rotor position relative to stator 18 whenever actuator 156 is not energized and enables lock pin 31 to engage lock pin seat 62 at the predetermined rotor position.

While rotary valve spool vanes 80 have been illustrated and described herein as being grounded to rotor 20, it should now be understood that rotary valve spool 28 may be reconfigured so as to ground rotary valve spool vanes 80 to front cover 24 or some other component that rotates together with stator 18, thereby grounding rotary valve spool vanes 80 in effect to stator 18. When rotary valve spool vanes 80 are grounded in effect to stator 18, rotary valve spool 28 permits self-correction of drift of rotor 20 as disclosed in U.S. patent application Ser. No. 14/554,385 to Haltiner and in U.S. patent application Ser. No. 14/554,400 to Haltiner et al., the disclosures of which are incorporated herein by reference in their entirety. It should be noted that biasing arrangement 32 does in effect position rotary valve spool 28 relative to stator 18 so that the position of rotor 20 is self-correcting when actuator 156 is not energized.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining a phasing advance chamber and a phasing retard chamber with said input member; and a rotary valve spool coaxially disposed within said output member such that said rotary valve spool is rotatable relative to said output member and said input member, said rotary valve spool defining a rotary valve spool advance chamber and a rotary valve spool retard chamber;

wherein oil supplied to said rotary valve spool advance chamber causes said rotary valve spool to rotate relative to said output member and relative to said input member in a retard direction;

wherein oil supplied to said rotary valve spool retard chamber causes said rotary valve spool to rotate relative to said output member and relative to said input member in an advance direction;

wherein rotation of said rotary valve spool in the advance direction allows oil to be supplied to said phasing retard chamber, thereby causing said output member to rotate relative to said input member in the advance direction; and wherein rotation of said rotary valve spool in the retard direction allows oil to be supplied to said phasing advance chamber, thereby causing said output member to rotate relative to said input member in the retard direction.

2. A camshaft phaser as in claim 1 further comprising a linear valve spool displaceable axially such that said linear valve spool controls oil flow to and from said rotary valve spool advance chamber and said rotary valve spool retard chamber.

3. A camshaft phaser as in claim 1 further comprising a biasing arrangement wherein:

said biasing arrangement applies torque to said rotary valve spool in the retard direction when said rotary valve spool is advanced of a predetermined rotary valve spool position relative to said input member; and said biasing arrangement applies torque to said rotary valve spool in the advance direction when said rotary valve spool is retarded of said predetermined rotary valve spool position.

4. A camshaft phaser as in claim 3 further comprising a lock pin which selectively prevents rotation between said output member and said input member when said output member is in a predetermined output member position relative to said input member which is determined by said predetermined rotary valve spool position.

5. A camshaft phaser as in claim 1 wherein:

said input member is a stator having a plurality of lobes;

said output member is a rotor coaxially disposed within said stator, said rotor having a plurality of vanes interspersed with said plurality of lobes;

said phasing advance chamber is one of a plurality of phasing advance chambers defined by said plurality of vanes and said plurality of lobes; and said phasing retard chamber is one of a plurality of phasing retard chambers defined by said plurality of vanes and said plurality of lobes.

6. A camshaft phaser as in claim 5 wherein:

said rotary valve spool advance chamber is one of a plurality of rotary valve spool advance chambers defined by said rotary valve spool; and said rotary valve spool retard chamber is one of a plurality of rotary valve spool retard chambers defined by said rotary valve spool.

7. A camshaft phaser as in claim 6 wherein said rotary valve spool is rotatably disposed within a rotor valve spool bore of said rotor.

8. A camshaft phaser as in claim 7 wherein said plurality of rotary valve spool advance chambers and said plurality of rotary valve spool retard chambers are further defined by said rotor valve spool bore.

9. A camshaft phaser as in claim 8 further comprising a plurality of rotary valve spool vanes where each one of said plurality of rotary valve spool vanes separates one of said plurality of rotary valve spool advance chambers from one of said plurality of rotary valve spool retard chambers.

10. A camshaft phaser as in claim 9 wherein each of said plurality of rotary valve spool vanes is fixed to said rotor to prevent relative rotation between said plurality of rotary valve spool vanes and said rotor.

11. A camshaft phaser as in claim 10 wherein relative rotation between said plurality of rotary valve spool vanes and said rotor is prevented by each of said plurality of rotary valve spool vanes having a rotary valve spool vane rib extending radially outward therefrom which engages a respective complementary rotor notch which extends radially outward from said rotor valve spool bore.

12. A camshaft phaser as in claim 9 wherein said rotary valve spool is rotatable relative to said plurality of rotary valve spool vanes.

13. A camshaft phaser as in claim 6 further comprising a linear valve spool displaceable axially such that said linear valve spool controls oil flow to and from said plurality of rotary valve spool advance chambers and said plurality of rotary valve spool retard chambers.

14. A camshaft phaser as in claim 13 wherein said linear valve spool is axially displaceable between an advance position and a retard position wherein:

said advance position allows oil to flow into said plurality of rotary valve spool retard chambers from an oil source and allows oil to be vented from said plurality of rotary valve spool advance chambers; and said retard position allows oil to flow into said plurality of rotary valve spool advance chambers from said oil source and allows oil to be vented from said plurality of rotary valve spool retard chambers.

15. A camshaft phaser as in claim 14 wherein said linear valve spool is axially displaceable between a default position in addition to said advance position and said retard position wherein said default position places said plurality of rotary valve spool advance chambers in fluid communication with said plurality of rotary valve spool retard chambers.

16. A camshaft phaser as in claim 15 further comprising a biasing arrangement wherein:

said biasing arrangement applies torque to said rotary valve spool in the retard direction when said rotary valve spool is advanced of a predetermined rotary valve spool position relative to said stator, thereby rotating said rotary valve spool relative to said rotor and said stator when said linear valve spool is in said default position in order to position said rotary valve spool in said predetermined rotary valve spool position by allowing oil to flow from said plurality of rotary valve spool retard chambers to said plurality of rotary valve spool advance chambers; and said biasing arrangement applies torque to said rotary valve spool in the advance direction when said rotary valve spool is retarded of said predetermined rotary valve spool position, thereby rotating said rotary valve spool relative to said rotor and said stator when said linear valve spool is in said default position in order to position said rotary valve spool in said predetermined rotary valve spool position by allowing oil to flow from said plurality of rotary valve spool advance chambers to said plurality of rotary valve spool retard chambers.

17. A camshaft phaser as in claim 16 wherein said biasing arrangement comprises:

an advance bias spring which applies torque to said rotary valve spool in the advance direction when said rotary valve spool is retarded of said predetermined rotary valve spool position; and a retard bias spring which applies torque to said rotary valve spool in the retard direction when said rotary valve spool is advanced of said predetermined rotary valve spool position relative to said stator.

18. A camshaft phaser as in claim 17 further comprising:

a back cover closing one axial end of said stator;

a front cover closing the other axial end of said stator such that said plurality of phasing advance chambers and said plurality of phasing retard chambers are defined axially between said back cover and said front cover, said front cover having a front cover central bore extending coaxially therethrough;

wherein said rotary valve spool is rotatably disposed within a rotor valve spool bore of said rotor; and wherein said rotary valve spool is captured axially between said rotor valve spool bore and said front cover.

19. A camshaft phaser as in claim 18 wherein said rotary valve spool includes a bias spring extension which extends through said front cover central bore such that said advance bias spring engages said bias spring extension when said rotary valve spool is retarded of the predetermined rotary valve spool position and such that said retard bias spring engages said bias spring extension when said rotary valve spool is advanced of the predetermined rotary valve spool position.

20. A camshaft phaser as in claim 14 wherein said linear valve spool is axially displaceable between a hold position in addition to said advance position and said retard position wherein said hold position prevents oil from entering and exiting said plurality of rotary valve spool advance chambers and said plurality of rotary valve spool retard chambers, thereby preventing said rotary valve spool from rotating relative to said rotor.

21. A camshaft phaser as in claim 6 further comprising a biasing arrangement wherein:

said biasing arrangement applies torque to said rotary valve spool in the retard direction when said rotary valve spool is advanced of a predetermined rotary valve spool position relative to said stator; and said biasing arrangement applies torque to said rotary valve spool in the advance direction when said rotary valve spool is retarded of said predetermined rotary valve spool position.

22. A camshaft phaser as in claim 21 further comprising a lock pin which selectively prevents rotation between said rotor and said stator when said rotor is in a predetermined rotor position relative to said stator which is determined by said predetermined rotary valve spool position.

23. A camshaft phaser as in claim 21 wherein said biasing arrangement comprises:

an advance bias spring which applies torque to said rotary valve spool in the advance direction when said rotary valve spool is retarded of said predetermined rotary valve spool position; and a retard bias spring which applies torque to said rotary valve spool in the retard direction when said rotary valve spool is advanced of a predetermined rotary valve spool position relative to said stator.

24. A camshaft phaser as in claim 23 wherein:

one end of said advance bias spring is grounded to said stator and the other end of said advance bias spring engages said rotary valve spool only when said rotary valve spool is retarded of said predetermined rotary valve spool position; and one end of said retard bias spring is grounded to said stator and the other end of said retard bias spring engages said rotary valve spool only when said rotary valve spool is advanced of said predetermined rotary valve spool position.

25. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining a phasing advance chamber and a phasing retard chamber with said input member;

a rotary valve spool coaxially disposed within said output member such that said rotary valve spool is rotatable relative to said output member and said input member; and a biasing arrangement which applies torque to said rotary valve spool toward a predetermined rotary valve spool position relative to said input member;

wherein rotation of said rotary valve spool in an advance direction allows oil to be supplied to said phasing retard chamber, thereby causing said output member to rotate relative to said input member in the advance direction; and wherein rotation of said rotary valve spool in a retard direction allows oil to be supplied to said phasing advance chamber, thereby causing said output member to rotate relative to said input member in the retard direction.

26. A camshaft phaser as in claim 25 wherein:

said biasing arrangement applies torque to said rotary valve spool in the retard direction when said rotary valve spool is advanced of the predetermined rotary valve spool position; and said biasing arrangement applies torque to said rotary valve spool in the advance direction when said rotary valve spool is retarded of said predetermined rotary valve spool position.

27. A camshaft phaser as in claim 26 wherein said biasing arrangement comprises:

an advance bias spring which applies torque to said rotary valve spool in the advance direction when said rotary valve spool is retarded of said predetermined rotary valve spool position; and a retard biasing spring which applies torque to said rotary valve spool in the retard direction when said rotary valve spool is advanced of said predetermined rotary valve spool position.

* * * * *